US007575135B2

(12) United States Patent
Awajiya et al.

(10) Patent No.: US 7,575,135 B2
(45) Date of Patent: Aug. 18, 2009

(54) IMMERSION NOZZLE FOR CONTINUOUS CASTING OF STEEL AND METHOD OF CONTINUOUS CASTING METHOD OF STEEL

(75) Inventors: Yutaka Awajiya, Tokyo (JP); Mikio Suzuki, Tokyo (JP); Keiji Watanabe, Tokyo (JP); Makoto Iiyama, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 481 days.

(21) Appl. No.: 10/500,789

(22) PCT Filed: Jan. 27, 2003

(86) PCT No.: PCT/JP03/00710

§ 371 (c)(1),
(2), (4) Date: Apr. 11, 2005

(87) PCT Pub. No.: WO03/064079

PCT Pub. Date: Aug. 7, 2003

(65) Prior Publication Data

US 2005/0173473 A1 Aug. 11, 2005

(30) Foreign Application Priority Data

Jan. 28, 2002 (JP) ..... 2002-017925
Apr. 1, 2002 (JP) ..... 2002-098845
Dec. 26, 2002 (JP) ..... 2002-377845

(51) Int. Cl.
*B22D 41/00* (2006.01)

(52) U.S. Cl. ..... 222/590; 164/473

(58) Field of Classification Search ..... 222/590; 164/459, 473

See application file for complete search history.

(56) References Cited

U.S. PATENT DOCUMENTS 5,587,101 A * 12/1996 Hattanda et al. ..... 222/603
5,616,188 A * 4/1997 Kato et al. ..... 147/508
6,279,790 B1 8/2001 Nomura et al.

FOREIGN PATENT DOCUMENTS

| | | | |
|---|---|---|---|
| EP | 1 036 614 | A1 | 9/2000 |
| EP | 1 053 808 | A1 | 11/2000 |
| JP | 56-022672 | A | 3/1981 |
| JP | 57-56377 | A | 4/1982 |
| JP | 1-122644 | A | 5/1989 |
| JP | 1-205858 | A | 8/1989 |
| JP | 4-28463 | A | 1/1992 |
| JP | 4-94850 | A | 3/1992 |
| JP | 5-105506 | A | 4/1993 |
| JP | 6-100356 | A | 4/1994 |
| JP | 8-281393 | A | 10/1996 |
| JP | 11-314142 | A | 11/1999 |
| JP | 2000-263200 | A | 9/2000 |
| JP | 2003-10949 | A | 1/2003 |
| TW | 418131 | B | 1/2001 |

* cited by examiner

*Primary Examiner*—Scott Kastler
(74) *Attorney, Agent, or Firm*—Frishauf, Holtz, Goodman & Chick, P.C.

(57) ABSTRACT

An immersion nozzle for continuous casting of steel supplies molten steel into a mold. At least a part of the immersion nozzle is formed of a refractory having a desulfurizing ability. A method for continuous casting of steel employs the immersion nozzle to supply molten steel into a mold using the immersion nozzle for continuous casting.

29 Claims, 7 Drawing Sheets

IMMERSION NOZZLE FOR CONTINUOUS CASTING OF STEEL AND METHOD OF CONTINUOUS CASTING METHOD OF STEEL

This application is a U.S. National Phase Application under 35 USC 371 of International Application PCT/JP03/00710 filed Jan. 27, 2003.

FIELD OF THE INVENTION

The present invention relates to immersion nozzles for steel continuous casting and continuous casting method of steel using the same, the immersion nozzles supplying molten steel into a mold when steel continuous casting is performed. More particularly, the present invention relates to an immersion nozzle for steel continuous casting, which can prevent a molten-steel introducing port from being blocked by $Al_2O_3$ deposition onto an inner wall portion, and related to a continuous casting method of steel.

DESCRIPTION OF THE RELATED ARTS

In manufacturing of aluminum-killed steel, molten steel refined by oxidizing decarburization is deoxidized by Al, and the amount of oxygen in the molten steel is removed which is increased by refining of the oxidizing decarburization. $Al_2O_3$ particles formed in this deoxidation step are removed from the molten steel by floatation separation using the difference in density between molten steel and $Al_2O_3$; however, since the floating speed of fine $Al_2O_3$ particles having a size of several tens of micrometers or less is extremely slow, it has been very difficult to totally remove $Al_2O_3$ by the floatation separation in a practical process. Accordingly, fine $Al_2O_3$ particles remain in a suspended state in the aluminum-killed steel. In addition, in order to stably decrease the amount of oxygen contained in molten steel, dissolved Al is present in molten steel after Al deoxidation treatment, and when this Al is brought into contact with the air and oxidized in a tundish or in the course of pouring molten steel from a ladle to a tundish, $Al_2O_3$ is newly formed in the molten steel.

In addition, in steel continuous casting, when molten steel is poured from a tundish to a mold, an immersion nozzle made of a refractory is used. As properties required for this immersion nozzle, there may be mentioned high temperature strength, high heat shock resistance, and superior erosion resistance to a mold powder and molten steel, and as a result, $Al_2O_3$-graphite base and $Al_2O_3$—$SiO_2$-graphite base immersion nozzles, which have the properties mentioned above, have been widely used.

However, in the case in which $Al_2O_3$-graphite base or $Al_2O_3$—$SiO_2$-graphite base immersion nozzles are used, when flowing through an immersion nozzle made of $Al_2O_3$-graphite base or $Al_2O_3$—$SiO_2$-graphite base material, $Al_2O_3$ suspended in molten steel is deposited and accumulated on an inner wall of the immersion nozzle, and as a result, blocking of the immersion nozzle occurs.

When the immersion nozzle is blocked, various problems relating to casting operations and qualities of cast steel strands occur. For example, a drawing speed of cast steel strand must be inevitably decreased, resulting in decrease in productivity, and in an extreme case, casting operation is forced to stop. In addition, when $Al_2O_3$ deposited on an inner wall of the immersion nozzle is suddenly peeled away to form large $Al_2O_3$ particles, is discharged into a mold, and is then trapped in a solidification shell in the mold, defects of products occur. Furthermore, due to delay of solidification at this part, molten steel may flow out in some cases when a cast steel strand is drawn out under the mold, and as a result, even breakout may occur in some cases. Due to the reasons described above, mechanisms of deposition and accumulation of $Al_2O_3$ on an inner wall of an immersion nozzle, which occur in continuous casting of aluminum-killed steel, and preventive methods therefore have been investigated.

As mechanisms of $Al_2O_3$ deposition which have been believed, for example, there may be mentioned (1) $Al_2O_3$ suspended in molten steel collides against an inner wall of an immersion nozzle and is then deposited thereon; (2) since a temperature of molten steel is decreased when it flows through an immersion nozzle, the solubility of Al and oxygen in the molten steel is decreased, and $Al_2O_3$ is then crystallized, resulting in $Al_2O_3$ deposition on an inner wall; and (3) since SiO is formed by reaction between $SiO_2$ and graphite in an immersion nozzle, $Al_2O_3$ is formed on an inner wall of the immersion nozzle by reaction of the SiO with Al contained in molten steel so as to cover the surface thereof, and fine $Al_2O_3$ particles suspended in the molten steel then collide against the $Al_2O_3$ thus formed, resulting in deposition and accumulation of $Al_2O_3$.

Accordingly, based on the mechanisms on deposition and accumulation described above, the following various measures have been proposed. For example, as measures for preventing $Al_2O_3$ deposition, there have been proposed (1) a gas film is formed between molten steel and an inner wall of an immersion nozzle by feeding Ar to the inner wall thereof so that $Al_2O_3$ is prevented from being brought into contact with the wall (for example, refer to Japanese Unexamined Patent Application Publication No. 4-28463); (2) in order to prevent a temperature of molten steel at an inner wall side of an immersion nozzle from decreasing, a part of the immersion nozzle is formed of an electrically conductive ceramic and is heated by high-frequency heating from outside of the immersion nozzle, or in order to decrease the amount of heat conduction through the wall of the immersion nozzle, a two-layered wall structure is formed or a heat insulating layer is provided in the wall thickness of the immersion nozzle (for example, refer to Japanese Unexamined Patent Application Publication No. 1-205858); and (3) an immersion nozzle made of a material containing a reduced amount of $SiO_2$, which is used as an oxygen source, is used for suppressing the formation of $Al_2O_3$ (for example, refer to Japanese Unexamined Patent Application Publication No. 4-94850). In addition, as measures for removing $Al_2O_3$ deposited onto an inner wall of an immersion nozzle, for example, there has been proposed (4) a component which forms a low melting point compound by reaction with $Al_2O_3$ is contained in a material forming an immersion nozzle, and $Al_2O_3$ deposited onto an inner wall of the immersion nozzle is allowed to flow out in the form of the low melting point compound (for example, refer to Japanese Unexamined Patent Application Publication No. 1-122644).

However, the measures described above have the following problems. That is, according to the measure (1) described above, part of the Ar gas fed into the immersion nozzle cannot escape from the surface of the molten steel in the mold and is trapped in a solidification shell. In pores (pinholes) generated by the trapped Ar gas, inclusions are also observed in many cases, resulting in defects of products. In addition, when part of the Ar gas is trapped at a surface portion of a cast steel strand, the interior surfaces of the pores are oxidized in a continuous casting machine or a heating furnace before rolling, and those mentioned above are not scaled off in some cases, resulting in defects of products.

In order to solve the problem of pinholes formed by Ar bubbles as described above, Ca is added to molten steel to change the composition of inclusions from alumina to calcium aluminate, so that the form of the inclusions is changed from solid to liquid. As a result, the deposition and accumulation of the inclusions on the inner wall of the immersion nozzle are prevented. In this casting method, even when an Ar gas is not fed, casting can be performed without generating $Al_2O_3$ deposition. However, according to this method, since being turned into the liquid form, the inclusions are difficult to be separated from the molten steel and are poured into a mold together therewith, and as a result, a cast steel strand containing a large amount of inclusions is formed. Hence, there has been a problem in that the purity is degraded.

According to the measure (2) described above, the effect of preventing solidification of steel on the inner wall of the immersion nozzle can be obtained; however, the effect of preventing $Al_2O_3$ deposition is not significant. Those described above can also be understood from the result in that the amount of $Al_2O_3$ deposited and accumulated on a part of the inner wall of the nozzle immersed in molten steel is large.

According to the measure (3) described above, since the content of $SiO_2$ in the material of the immersion nozzle is decreased, the heat shock resistance of the immersion nozzle is degraded. In general, immersion nozzles are used after preheating. The reason for this is that a refractory has a low heat shock resistance and is liable to be cracked. $SiO_2$ has a significantly superior effect of improving the heat shock resistance, and hence when the content of $SiO_2$ is decreased, the rate of occurrence of cracking in the immersion nozzle becomes extremely high when molten steel flows therethrough right after the start of casting.

In addition, according to the measure (4) described above, for example, by adding CaO as a constituent material of the immersion nozzle, a low melting point compound is formed by reaction between CaO and $Al_2O_3$, and this compound is then poured into a mold together with molten steel. Accordingly, the $Al_2O_3$ deposition onto the inner wall of the immersion nozzle can be prevented. However, since the low melting point compound which forms inclusions is poured into the mold, there has been a problem in that the purity of a cast steel strand is degraded. In addition, since the inner wall of the immersion nozzle is worn away, this method cannot be suitably used for casting which lasts for a long period of time.

As has thus been described above, the conventional measures for preventing $Al_2O_3$ deposition can prevent the immersion nozzle from being blocked; however, for example, the amount of inclusions in a cast steel strand may be increased and the stability of operation may be interfered with in some cases. Hence, the measures of preventing $Al_2O_3$ deposition, which can meet all the requirements in view of the operation and the quality of cast steel strands, have not been established as of today.

SUMMARY OF THE INVENTION

It is an object of the present invention to provide an immersion nozzle for steel continuous casting and a method for continuous casting of steel, in which, in steel continuous casting, the immersion nozzle can prevent blocking caused by $Al_2O_3$ contained in molten steel without degrading the stability of continuous casting operation and the purity of cast steel strands.

First of all, a first aspect of the present invention will be described.

In order to understand the mechanism of deposition and accumulation of $Al_2O_3$ particles onto an inner wall surface of an immersion nozzle, the inventors of the present invention carried out an $Al_2O_3$ deposition test in which refractory bars made of an $Al_2O_3$-graphite base refractory material were immersed in aluminum-killed molten steel.

Subsequently, according to the results obtained by the investigation of the influence of an S concentration in molten steel on the deposition and accumulation, the following facts were found. That is, they are: (1) as the S concentration in molten steel is increased, the thickness of $Al_2O_3$ deposition is increased; (2) when the S concentration in molten steel is set to 0.002 mass percent or less, the $Al_2O_3$ deposition does not occur; (3) as is the case of an S element, when Se or Te, which is also a surface-active element, is added to molten steel, the same phenomena as that of the above (1) and (2) occur.

According to the results thus obtained, the $Al_2O_3$ deposition mechanism is construed as follows. That is, since an S atom which is a surface-active element tends to accumulate at the interface between an inner wall surface of an immersion nozzle and molten steel, the concentration distribution is formed in which the S concentration of molten steel is high at the side of the inner wall surface of the nozzle and is gradually decreased along the direction to the side opposite to the inner wall surface. In this case, as shown in FIG. 1(*a*), when the inner wall surface of the immersion nozzle is regarded as 0 and the direction toward the side opposite to the inner wall surface is regarded as "positive", the slope of the concentration shows a negative value. When $Al_2O_3$ particles enter a concentration boundary layer having the S concentration slope as described above, the S concentration of the $Al_2O_3$ particles at the inner wall surface side of the nozzle is high and that at the side opposite thereto is low. In addition, it has been known that the surface tension between $Al_2O_3$ and molten steel largely depends on the S concentration, and that the surface tension is increased as the S concentration is increased. Hence, as shown in FIG. 1(*a*), the surface tension of the $Al_2O_3$ particles is low at a side close to the inner wall surface of the nozzle and is high at a side far therefrom. Due to this difference in surface tension, the $Al_2O_3$ particles are attracted to the inner wall surface side of the nozzle and are liable to accumulate thereon.

In this case, when the S concentration in molten steel is increased, since the thickness of the concentration boundary layer is increased as the S concentration at the interface between the inner wall surface of the nozzle and molten steel is increased, $Al_2O_3$ particles are likely to enter the concentration boundary layer, and an attraction force toward the inner wall surface side of the nozzle is increased. Accordingly, the amount of $Al_2O_3$ deposition is increased. On the other hand, when the S concentration in molten steel is extremely decreased, since the S concentration at the interface is decreased, and the concentration boundary layer is also decreased, $Al_2O_3$ particles are unlikely to enter the concentration boundary layer, and the attraction force toward the inner wall surface side of the nozzle is decreased. As a result, the $Al_2O_3$ deposition is unlikely to occur.

When the $Al_2O_3$ deposition mechanism is construed as described above, as shown in FIG. 1(*b*), when the S concentration in molten steel at the inner wall surface portion of the nozzle is decreased as compared to that in molten steel apart from the inner wall of the nozzle, the attraction force by the surface tension is changed to an opposite repulsion force, and $Al_2O_3$ particles move away from the inner wall of the nozzle as if being repulsed there from.

Accordingly, through intensive research on means for forming the "positive" S concentration slope as shown in FIG. 1(*b*) by decreasing the S concentration in molten steel at the inner wall surface portion of the nozzle, it was finally found that the above means can be obtained when at least a part of a refractory forming the immersion nozzle has a desulfurizing ability. That is, when the refractory forming the immersion nozzle has a desulfurizing ability, molten steel present in the vicinity of the inner wall surface of the nozzle is desulfurized by the refractory having a desulfurizing ability, the S concentration at the above portion is decreased, and as a result, the "positive" S concentration slope as shown in FIG. 1(*b*) can be formed.

Those thus considered were confirmed by a particular experiment. For the experiment, a round bar was machined from an immersion nozzle made of an $Al_2O_3$-graphite base refractory material, a cylinder-shaped hole was formed in this round bar along the central axis thereof, and powdered MgO and a metal reducing this powdered MgO were mixed together and were filled in this hole. As a powdered metal used as a reducing agent, for example, one metal was selected from Al, Ti, Zr, Ca, and Ce and was then further mixed with powdered carbon. The mixture thus prepared was filled in the cylinder-shaped hole formed in a test piece made of the refractory. This test piece was immersed in molten aluminum-killed steel melted in a chamber which could be evacuated, and after the pressure inside the chamber was reduced to less than the atmospheric pressure (approximately 0.7 atm), an $Al_2O_3$ deposition test was performed. The pressure inside the hole filled with the metal and the powdered carbon was held at the atmospheric pressure. Inside the test piece, the powdered MgO and the metal reacted with each other to form a Mg metal, and Mg was then gasified. Due to the difference in pressure between the inside of the hole and that of the chamber, the Mg gas passed through the wall of the test piece and then slowly effused from the surface thereof. By this test, it was confirmed that no $Al_2O_3$ particles deposit on the surface of the test piece at all. In addition, it was also confirmed that MgS is generated on the surface of the test piece. From the results described above, the following process can be construed. Since the Mg gas which passed through the test piece and S contained in molten steel react with each other, the S concentration of the molten steel at the portion mentioned above is decreased by desulfurization, and the "positive" S concentration slope can be formed. Accordingly, the reason $Al_2O_3$ particles do not deposit on the surface of the test piece is understood. That is, the validity of the above mechanism can be confirmed in which since the refractory forming the immersion nozzle has a desulfurizing ability, the molten steel present at the inner wall surface portion of the nozzle is desulfurized by the refractory having a desulfurizing ability so that the S concentration at that portion is decreased, and the $Al_2O_3$ particles are repulsed from the inner wall of the nozzle.

The first aspect of the present invention was made based on the above findings by the inventors of the present invention and provides an immersion nozzle for steel continuous casting, which supplies molten steel into a mold. In the immersion nozzle described above, at least a part of the immersion nozzle is formed of a refractory having a desulfurizing ability.

In addition, in accordance with a second aspect of the present invention, there is provided an immersion nozzle for steel continuous casting, which supplies molten steel into a mold. In the immersion nozzle described above, at least a part of the immersion nozzle is formed of a refractory which comprises a refractory material including an oxide and a component for reducing the oxide, the oxide containing an alkaline earth metal. When this type of refractory is used, $Al_2O_3$ deposition onto the inner wall of the immersion nozzle can be prevented. Although various mechanisms of preventing $Al_2O_3$ deposition onto the inner wall surface of the immersion nozzle may be considered, the reason $Al_2O_3$ particles do not deposit may also be described as follows in accordance with the mechanism described above. That is, the oxide, which contains an alkaline earth metal, in the refractory is reduced by the reducing component described above to form an alkaline earth metal, and this alkaline earth metal thus formed reacts with S in the molten steel, thereby desulfurizing the molten steel.

The oxide containing an alkaline earth metal is preferably primarily composed of MgO, and the component reducing the oxide is preferably at least one metal selected from the group consisting of Al, Ti, Zr, Ce, and Ca. In addition, the refractory may further comprise carbon. When carbon is contained, an Al metal, a Ti metal, a Zr metal, a Ce metal, and a Ca metal in the refractory can be prevented from being oxidized while the immersion nozzle is pre-heated, and as a result, the reduction efficiency for MgO can be improved.

In accordance with a third aspect of the present invention, there is provided an immersion nozzle for steel continuous casting, which supplies molten steel into a mold. In the immersion nozzle described above, at least a part of the immersion nozzle is formed of a refractory which comprises a refractory material including MgO, which is a typical example of the refractory, and an Al metal. In this case, the refractory described above may further contain carbon. As is the case described above, the $Al_2O_3$ deposition onto the inner wall surface of the immersion nozzle can be effectively prevented, and although various mechanisms thereof may be considered, the following particular mechanism may also be construed based the findings described below.

When the refractory comprising a refractory material including MgO and an Al metal is used for at least a part of the immersion nozzle, due to the molten steel flowing through a molten-steel introducing port of the immersion nozzle, the immersion nozzle is heated to approximately 1,200 to 1,600° C. (approximately 1,500° C. at the inner wall surface of the immersion nozzle, approximately 900 to 1,200° C. at the outer wall surface thereof, and approximately 1,540° C. at a part of the immersion nozzle immersed in molten steel in the mold), and the MgO and the Al metal present in the immersion nozzle are also heated with or without carbon. As a result, reaction represented by equation (1) shown below occurs between the MgO and the Al metal, and when the carbon is contained, the reaction represented by the equation (1) and reaction represented by equation (2) occur. In both cases, an Mg gas is generated in the refractory.

$$3MgO(s)+2Al(l)\rightarrow 3Mg(g)+Al_2O_3(s) \quad (1)$$

$$MgO(s)+C(s)\rightarrow Mg(g)+CO(g) \quad (2)$$

The reaction represented by the equation (1) also occurs with a Ti metal, a Zr metal, a Ce metal, or a Ca metal as is the case of the Al metal. In addition to the reaction represented by the equation (2), the carbon serves to prevent the oxidation of the metal while the immersion nozzle is pre-heated.

As described later, since the pressure inside the molten-steel introducing port of the immersion nozzle through which the molten steel flows at a high speed is evacuated to less than the atmospheric pressure, and in addition, since the refractory material forming the immersion nozzle generally has a porosity of ten and several percent to twenty and several percent, the Mg gas generated in the refractory in the immersion nozzle diffuses through the side wall thereof and reaches the inner wall surface of the immersion nozzle.

Since the molten steel is present at the inner wall surface side of the immersion nozzle, and Mg has a strong affinity to S, the Mg gas react with S present in the boundary layer between the inner wall surface of the immersion nozzle and the molten steel to form MgS, and as a result, the S concentration at that portion is decreased. The slope of the S concentration in molten steel in the vicinity of the inner wall surface of the nozzle is formed so that the concentration is low at the immersion nozzle side and is high at the molten steel side. As a result, in $Al_2O_3$ particles present in the boundary layer between the inner wall surface of the immersion nozzle and the molten steel, the difference in surface tension with the molten steel is generated between the immersion nozzle side and the molten steel side, and due to this difference in surface tension, the $Al_2O_3$ particles move in the direction toward the side opposite to the inner wall surface of the immersion nozzle as if being repulsed there from. According to the effect described above, $Al_2O_3$ particles will not deposit on the inner wall surface of the immersion nozzle, and hence the nozzle is prevented from being blocked by $Al_2O_3$. Since the reaction generating MgS described above may be regarded as a desulfurizing reaction, this reaction may also be construed that the molten steel present in the vicinity of the inner wall of the immersion nozzle is desulfurized by the refractory forming the immersion nozzle. That is, it may also be construed that since the refractory comprising a refractory material including MgO and an Al metal has a desulfurizing ability, the $Al_2O_3$ deposition can be prevented.

In the case of a general immersion nozzle in which a refractory including MgO and an Al metal or a refractory including MgO, an Al metal, and Al is not provided, since the pressure inside the molten-steel introducing port of the immersion nozzle is reduced, the air passes through the side wall of the immersion nozzle and oxidizes the molten steel to form $Al_2O_3$, resulting in $Al_2O_3$ deposition. However, according to the immersion nozzle of the present invention, since the Mg gas generated inside the immersion nozzle interferes with the transmission of the air, the $Al_2O_3$ deposition can also be prevented by this effect.

In the case described above, the content of the MgO in the refractory is preferably set to 5 to 75 mass percent. The reasons for this are that when the content of the MgO is less than 5 mass percent, the above effect of preventing the deposition by the MgO gas is difficult to obtain, and when the content is more than 75 mass percent, the heat shock resistance and the like, which are required for immersion nozzles used for steel continuous casting, are degraded.

The content of said at least one metal of Al, Ti, Zr, Ce, and Ca is preferably 15 mass percent or less. When the metal is contained at a content of more than 15 mass percent, the effect of preventing $Al_2O_3$ deposition can be obtained; however, the effect thus obtained is not superior to an effect of preventing $Al_2O_3$ deposition obtained at a content of 15 mass percent or less. It is not preferable since a Ti metal, a Zr metal, a Ce metal, and a Ca metal, which are particularly expensive, cause increase in cost.

In particular, when the refractory comprises a refractory material including MgO and an Al metal, the content of the MgO in the refractory is preferably 5 to 75 mass percent, and the content of the Al metal is preferably 1 to 15 mass percent. The content of the Al metal is more preferably 2 to 15 mass percent and even more preferably 5 to 10 mass percent.

In addition, when the refractory comprises carbon, the content thereof is preferably 40 mass percent or less. The reason for this is that when the content of the carbon is more than 40 mass percent, the heat shock resistance and the like required for immersion nozzles for steel continuous casting are degraded.

The refractory material forming the refractory described above preferably includes CaO in addition to MgO. In the case in which the refractory has a desulfurizing ability, when CaO is contained, the desulfurizing effect can be improved. The MgS formed by the reaction between the Mg gas and S in the molten steel may be dissociated to the Mg gas and S by a reverse reaction which may occur when the supply amount of the Mg gas is decreased. When the S concentration in the molten steel present at the inner wall surface portion of the nozzle is increased due to the reverse reaction, since the S concentration slope becomes "negative", $Al_2O_3$ particles are attracted to the inner wall side of the nozzle, and as a result, deposition and accumulation of $Al_2O_3$ occur. In order to prevent this phenomenon, the presence of CaO is effective. That is, when CaO is present, an S atom formed by decomposition of MgS is dissolved in CaO and fixed, and as a result, the S concentration slope is prevented from being changed to "negative". As described above, when CaO is present, the desulfurizing effect can be improved. The content of the CaO in the refractory is preferably 5 mass percent or less. When the content is more than 5 mass percent, it is not preferable since moisture absorption of the refractory is increased. In addition, when the content of the CaO in the refractory is less than 0.5 mass percent, since an effect of promoting the desulfurizing effect is small, the content is preferably 0.5 mass percent or more.

In addition, at least one of $Al_2O_3$, $SiO_2$, $ZrO_2$, and $TiO_2$ may be contained in the refractory material. When the material mentioned above is contained, the high temperature strength and heat shock resistance of the refractory can be improved. In addition, by adding an appropriate amount of CaO, this effect can also be obtained in addition to the effect described above.

In accordance with a fourth aspect of the present invention, there is provided an immersion nozzle for steel continuous casting, which supplies molten steel into a mold. In the immersion nozzle described above, at least a part of the immersion nozzle is formed of a refractory which comprises a refractory material including spinel ($MgO.Al_2O_3$) and at least one metal selected from the group consisting of Al, Ti, Zr, Ce, and Ca.

When the refractory comprising an Al metal and the refractory material including spinel ($MgO.Al_2O_3$) is used for forming at least a part of the immersion nozzle, due to the molten steel flowing through a molten-steel introducing port of the immersion nozzle, the immersion nozzle is heated to approximately 1,200 to 1,600° C. (approximately 1,500° C. at the inner wall surface of the immersion nozzle, approximately 900 to 1,200° C. at the outer surface thereof, and approximately 1,540° C. at a part of the immersion nozzle immersed in molten steel in the mold), and the spinel ($MgO.Al_2O_3$) and the Al metal present in the immersion nozzle are also heated. As a result, reaction represented by equation (3) shown below occurs between the MgO present in the spinel and the Al metal, and an Mg gas is generated in the refractory. The equation (3) is basically equivalent to the equation (1).

$$3MgO(\text{in the spinel})+2Al(l)\rightarrow 3Mg(g)+Al_2O_3(s) \quad (3)$$

The reduction reaction of MgO represented by the above equation (3) also occurs with a Ti metal, a Zr metal, a Ce metal, or a Ca metal as is the case of the Al metal.

As is the case of the third aspect described above, the Mg gas generated inside the refractory by the above reaction diffuses through the side wall of the immersion nozzle and reacts with S present in the boundary layer between the molten steel and the inner wall surface of the immersion nozzle to form MgS. Accordingly, as is the mechanism described above, the $Al_2O_3$ deposition can be prevented. As described above, since the reaction generating MgS may be regarded as a desulfurizing reaction, this reaction may also be construed that the molten steel present in the vicinity of the inner wall of the immersion nozzle is desulfurized by the refractory forming the immersion nozzle. That is, it may be construed that since the refractory comprising an Al metal and a refractory material including the spinel ($MgO.Al_2O_3$) also has a desulfurizing ability, the $Al_2O_3$ deposition can be prevented.

In the case described above, the content of the spinel in the refractory is preferably set to 20 to 99 mass percent. The reasons for this are that when the content of the spinel is less than 20 mass percent, the effect of preventing the deposition by the MgO gas is difficult to obtain as described above, and that, on the other hand, when the content is more than 99 mass percent, other elements necessary for the reaction represented by the equation (3) cannot be contained.

In addition, the content of said at least one metal of Al, Ti, Zr, Ce, and Ca in the refractory including the spinel as described above is preferably 15 mass percent or less. When the metal is contained at a content of more than 15 mass percent, the effect of preventing $Al_2O_3$ deposition can be obtained; however, the effect thus obtained is not superior to an effect of preventing $Al_2O_3$ deposition obtained at a content of 15 mass percent or less. In addition, it is not preferable since a Ti metal, a Zr metal, a Ce metal, and a Ca metal, which are particularly expensive, cause increase in cost.

It is preferable that carbon be added to the refractory as described above. By this addition, oxidation of the Al metal, the Ti metal, the Zr metal, the Ce metal, and the Ca metal in the refractory can be prevented while the immersion nozzle is pre-heated, and hence, the reduction efficiency for MgO can be improved. In this case, the content of the carbon is preferably 40 mass percent or less. The reason for this is that when the content is more than 40 mass percent, spalling resistance and the like required for immersion nozzles for continuous casting are degraded.

When the refractory material forming the refractory includes CaO in addition to the spinel, as is the case of the third aspect described above, the desulfurizing effect can be improved. The content of the CaO in the refractory is preferably 5 mass percent or less. When the content is more than 5 mass percent, it is not preferable since moisture absorption of the refractory is increased. In addition, when the content of the CaO in the refractory is less than 0.5 mass percent, since the effect of promoting the desulfurizing effect is small, the content is preferably 0.5 mass percent or more.

In addition, in the refractory comprising the spinel as described above, at least one of MgO, $Al_2O_3$, $SiO_2$, $ZrO_2$, and $TiO_2$ may be contained as a refractory material in addition to the spinel. When the material mentioned above is contained, the high temperature strength and spalling resistance of the spinel-containing refractory material can be improved.

The immersion nozzles according to the first to the fourth aspects of the present invention may be entirely formed using the refractory described above; however, a part of the immersion nozzle described above may only be formed using the refractory described above. For example, the entire peripheral part of the molten-steel introducing port of the immersion nozzle may be formed of the refractory described above. In this case, the refractory describe above may be provided for all along the immersion nozzle in the height direction as is an immersion nozzle shown in FIG. 4 which will be described later or may be provided for a part the immersion nozzle in the height direction. In addition, in order to further ensure the effect of preventing $Al_2O_3$ deposition, the refractory described above is preferably provided at an inside portion which includes the molten-steel introducing port and which is filled with molten steel, that is, in particular, is preferably provided around the entire periphery of a part of the immersion nozzle up to the level of a molten steel surface (including the peripheral portion of a molten-steel discharge hole) when the immersion nozzle is immersed into the molten steel. Furthermore, the structure may be formed in which the refractory described above is supported by a supporting refractory. Accordingly, even when having a slightly inferior strength, the refractory described above can be used as the immersion nozzle. In particular, as described above, the structure is preferably formed in which the refractory described above is disposed around the entire peripheral portion of the molten-steel introducing port of the immersion nozzle or around the entire periphery of the inside portion of the immersion nozzle which includes the molten-steel introducing port and which is filled with molten steel, and as the supporting refractory, a refractory used for a general immersion nozzle is provided outside of the above-described refractory. Accordingly, in addition to the effect of preventing $Al_2O_3$ deposition, improvement in strength of the immersion nozzle can be obtained, and handling properties and serviceable time of the immersion nozzle can be made equivalent to those of a conventional immersion nozzle.

Next, a fifth aspect of the present invention will be described.

As described above, as shown in FIG. 1(*b*), when the S concentration in molten steel at the inner wall surface portion of the nozzle is decreased as compared to that in molten steel apart from the inner wall of the nozzle to form the "positive" S concentration slope, the attraction force by the surface tension is changed to an opposite repulsion force, and $Al_2O_3$ particles move away from the inner wall of the nozzle as if being repulsed therefrom. In order to realize the state described above, it was also found that injection of a gas having desulfurizing ability from the inner wall surface of the nozzle is also effective. That is, when a gas having a desulfurizing ability is injected from the inner wall surface of the nozzle, molten steel present at the inner wall surface portion of the nozzle is desulfurized by the gas described above, the S concentration at the above portion is decreased, and as a result, the state as shown in FIG. 1(*b*) can be formed.

Those described above were confirmed by a particular experiment. In this case, the following experiment was carried out in which in order to remove S in molten steel in the vicinity of the inner wall of the nozzle by fixing, a gas, such as an Mg gas, a Ca gas, an Mn gas, or a Ce gas, having a strong affinity to S was injected from the inner wall surface of the immersion nozzle so as to react with S. For the experiment, a round bar was machined from an immersion nozzle made of an $Al_2O_3$-graphite base refractory material, a cylinder-shaped hole was formed in this round bar along the central axis thereof, one metal selected from the group consisting of Mg, Ca, Mn, and Ce and powdered carbon mixed therewith were filled in this hole. The test piece thus formed was immersed in molten aluminum-killed steel melted in a chamber which could be evacuated, and after the pressure inside the chamber was reduced to less than the atmospheric pressure (approximately 0.7 atm), the $Al_2O_3$ deposition test was performed. The inside of the hole filled with the metal and the powdered carbon was allowed to communicate with the outside so that the pressure therein was held at the atmospheric pressure. Inside the test piece, the Mg, the Ca or the Ce metal was gasified by the heat of the molten steel to form an Mg gas, a Ca gas, an Mn gas, or a Ce gas. Due to the difference in pressure between the inside of the hole and the inside of the chamber, the Mg gas, the Ca gas, the Mn gas, or the Ce gas passed through the test piece and then effused from the surface thereof into molten steel. By this test, it was confirmed that no $Al_2O_3$ particles deposit on the surface of the test piece at all.

In addition, it was also confirmed that MgS, CaS, MnS, and CeS are generated on the surface of the test piece. From the results described above, the process can be construed as follows. Since the gas described above, which passed through the test piece and had a strong affinity to S, reacted with S in molten steel, molten steel present at the surface portion of the test piece was desulfurized, and the S concentration of the molten steel at that portion is decreased, thereby obtaining the "positive" S concentration slope. Accordingly, the reason $Al_2O_3$ particles do not deposit on the surface of the test piece is understood. That is, the validity of the mechanism can be confirmed in which by injecting a gas having a desulfurizing ability from the immersion nozzle, the molten steel present at the inner wall surface portion of the nozzle is desulfurized by the gas having a desulfurizing ability, the S concentration at that portion is decreased, and as a result, $Al_2O_3$ particles are repulsed from the inner wall of the nozzle.

The fifth aspect of the present invention was made based on the findings as described above, and in accordance with this aspect of the present invention, there is provided an immersion nozzle for steel continuous casting, which supplies molten steel into a mold, comprising: a molten-steel introducing port which is formed to be able to inject a gas having a desulfurizing ability from an inner wall surface thereof, wherein part of the molten steel flowing therethrough is desulfurized by the injected gas having a desulfurizing ability, said part of the molten steel being present at the inner wall surface portion of the immersion nozzle.

In the case described above, as the gas having a desulfurizing ability, at least one gas of Mg, Ca, Mn, and Ce is preferably used.

In accordance with a sixth aspect of the present invention, there is provided an immersion nozzle for steel continuous casting, which supplies molten steel into a mold, comprising a molten-steel introducing port which is formed to be able to inject at least one gas of Mg, Ca, Mn, and Ce from an inner wall surface thereof, wherein said at least one gas is injected to the molten steel flowing through the molten-steel introducing port.

In accordance with a seventh aspect of the present invention, there is provided an immersion nozzle for steel continuous casting, which supplies molten steel into a mold, comprising: a molten-steel introducing port, wherein the immersion nozzle is formed of a refractory material and a powdered metal having a desulfurizing ability, and part of the molten steel flowing through the molten-steel introducing port is desulfurized by a gas having a desulfurizing ability generated from the powdered metal by heat of the molten steel, said part of the molten steel being present at the inner wall surface portion of the immersion nozzle. As are the aspects described above, according to this seventh aspect of the present invention, since the gas having a desulfurizing ability reacts with the molten steel, $Al_2O_3$ particles are repulsed from the inner wall of the nozzle, and as a result, the $Al_2O_3$ particle deposition can be prevented. The metal having a desulfurizing ability in this aspect indicates a metal which forms a sulfide by reaction with sulfur.

In this case, the powdered metal having a desulfurizing ability is preferably at least one powdered metal of Mg, Ca, Mn, and Ce, and by heat of molten steel, at least one gas of Mg, Ca, Mn, and Ca is generated.

In accordance with an eighth aspect of the present invention, there is provided an immersion nozzle for steel continuous casting, which supplies molten steel into a mold, comprising a molten-steel introducing port, wherein the immersion nozzle is formed of a refractory material and at least one powdered metal of Mg, Ca, Mn, and Ce, and at least one gas of Mg, Ca, Mn, and Ce generated from the powdered metal by heat of the molten steel is supplied to the molten steel flowing through the molten-steel introducing port.

In this case, the particle size of the powdered Mg, Ca, Mn, and Ce metals is preferably 0.1 to 3 mm, and the content of said at least one powdered metal of Mg, Ca, Mn, and Ce in the immersion nozzle is preferably 3 to 10 mass percent.

In the immersion nozzles according to the fifth and sixth aspects of the present invention, for example, a slit is provided in a sidewall portion of the nozzle, and a gas having a desulfurizing ability, that is, preferably at least one gas of Mg, Ca, Mn, and Ce, is supplied into this slit from the outside with an inert gas used as a carrier gas. When the molten steel is supplied into the mold through the immersion nozzle, as described above, since flow control is performed by decreasing the cross-sectional area of a sliding nozzle part or a stopper part as compared that of the immersion nozzle, the inside of the molten-steel introducing port of the immersion nozzle through which the molten steel flows at a high speed is surely evacuated, and the pressure becomes below the atmospheric pressure. Accordingly, since the refractory material forming the immersion nozzle generally has a porosity of ten and several percent to twenty and several percent, the gas supplied into the slit is sucked to the side of a molten-steel flow hole and reaches the inner wall surface by transmission. The Mg, Ca, Mn, and Ce gases thus obtained react with S in the molten steel as shown below.

$$Mg(g)+[S]\rightarrow MgS(s)$$
$$Ca(g)+[S]\rightarrow CaS(s)$$
$$Mn(g)+[S]\rightarrow MnS(s)$$
$$Ce(g)+[S]\rightarrow CeS(s)$$

Accordingly, the molten steel at the inner wall surface portion of the immersion nozzle is desulfurized, and hence the S concentration at that portion is decreased. As a result, the "positive" S concentration slope is formed in which the S concentration of the molten steel in the vicinity of the inner wall surface of the nozzle is low at the inner wall surface side and is increased along the direction apart therefrom, and hence the $Al_2O_3$ deposition can be suppressed.

In the immersion nozzles according to the seventh and eighth aspects, the immersion nozzle for steel continuous casting is formed of a refractory material and a powdered metal having a desulfurizing ability, that is, preferably at least one powdered metal of Mg, Ca, Mn, and Ce. In casting, the immersion nozzle is heated to approximately 1,000 to 1,600° C. by the molten steel flowing through the molten-steel flow hole which is located at a central portion of the immersion nozzle. The powdered Mg, Ca, and Ce metals, which are mixed and compounded with the refractory material of the immersion nozzle, are also heated as is the immersion nozzle, and when being heated to the melting point or above, the powdered metal is gasified. The melting points of Mg, Ca, Mn, and Ce are 659° C., 843° C., 1,244° C., and approximately 650° C., respectively, and the powdered metal contained inside the refractory forming the immersion nozzle is sufficiently gasified. The Mg, Ca, Mn, and Ce gases thus generated reach the inner wall surface by transmission due to the difference in pressure as described above and are then allowed to react with S in the molten steel, and hence the S concentration in part of the molten steel in contact with the inner wall surface of the nozzle is decreased. As a result, the "positive" S concentration slope is formed in which the S concentration in the molten steel in the vicinity of the inner wall surface of the nozzle is low at the inner wall surface side and is increased along the direction apart from the inner wall, and hence the $Al_2O_3$ deposition can be suppressed.

According to the present invention, by the use of the immersion nozzle which is formed as described above, molten steel is supplied into a mold for continuous casting. In this case, the molten steel can be poured into the mold without feeding an Ar gas to the molten steel flowing through the molten-steel introducing port of the immersion nozzle. As described above, according to the immersion nozzle of the present invention, since the $Al_2O_3$ deposition onto the inner wall surface thereof can be prevented, the feed of an Ar gas into the molten-steel introducing port of the immersion nozzle, which has been performed as a preventive measure against the $Al_2O_3$ deposition, can be omitted. As a result, defects of products at surface portions of cast steel strands caused by Ar bubbles can be prevented. Heretofore, when continuous casting is performed without feeding an Ar gas, molten-steel treatment is performed in which a Ca metal is added to molten steel. However, in casting of aluminum-killed steel using the immersion nozzle according to the present invention, without performing the Ca addition treatment, continuous casting can be performed at an Ar gas flow rate of 3 NL/min or less (including 0), that is, continuous casting can be performed under the conditions in which an Ar gas is not fed at all or a very small amount thereof is only fed.

BRIEF DESCRIPTION OF THE DRAWINGS

FIG. 1(*b*) is another view for illustrating the principle of an $Al_2O_3$ deposition mechanism according to the present invention.

FIG. 3(*b*) is a plan cross-sectional view schematically showing one example of the immersion nozzle of the first embodiment according to the present invention.

FIG. 4(*b*) is a plan cross-sectional view schematically showing another example of the immersion nozzle of the first embodiment according to the present invention.

EMBODIMENT FOR CARRYING OUT THE INVENTION

Hereinafter, embodiments of the present invention will be described with reference to accompanying drawings.

Figure 1:
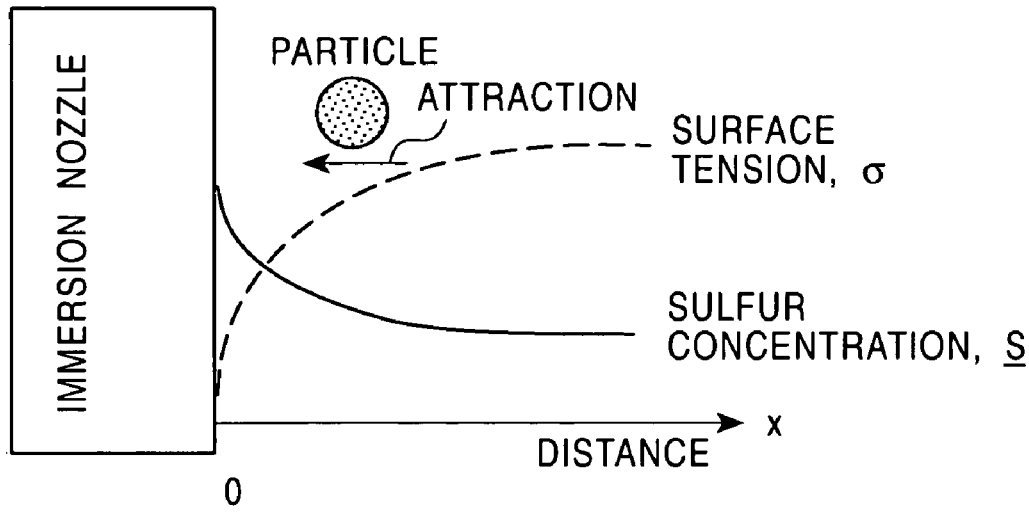
FIG. 1(*a*) is a view for illustrating the principle of an $Al_2O_3$ deposition mechanism according to the present invention.
Figure 1:
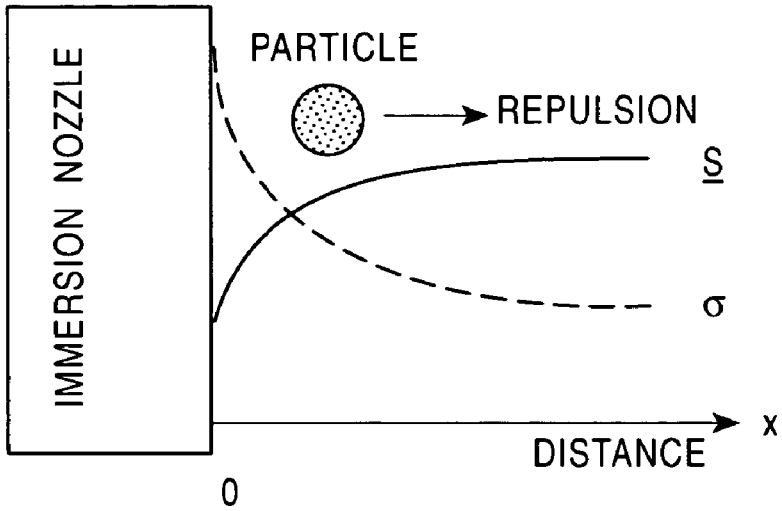
Figure 2:
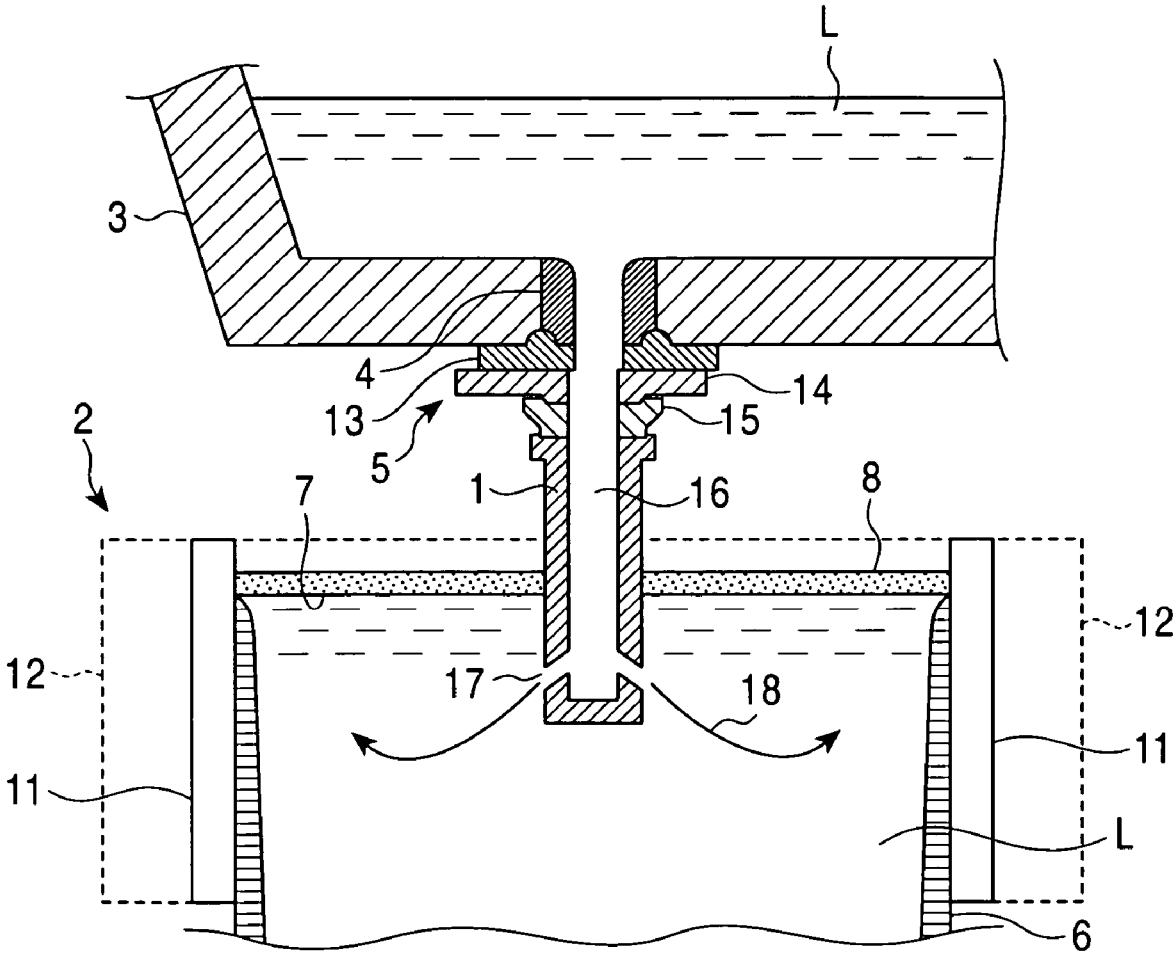
FIG. 2 is a cross-sectional view of a mold portion of a steel continuous casting machine using an immersion nozzle of the present invention.

FIG. 2 is a schematic cross-sectional view of a mold portion of a steel continuous casting machine to which the present invention is to be applied. This steel continuous casting machine has a mold 2 formed of mold long copper plates 11 facing each other and mold short copper plates 12 which face each other and which are provided inside the mold long copper plates 11, and above this mold 2, a tundish 3 is provided which has an inside enforced with a refractory and which is used to store molten steel L. At the bottom of this tundish 3, an upper nozzle 4 is provided, and a sliding nozzle 5 is connected to this upper nozzle 4, the sliding nozzle 5 being composed of a fixing plate 13, a sliding plate 14, and a rectifying nozzle 15. At the bottom side of the sliding nozzle 5, an immersion nozzle 1 is provided. In addition, a molten-steel flow hole 16 is formed through which the molten steel L flows from the tundish 3 to the mold 2.

The immersion nozzle 1 is immersed in the molten steel L in the mold 2, and at the bottom end portion of the immersion nozzle 1, molten-steel discharge holes 17 are formed. A molten-steel stream 18 is supplied toward the mold short copper plates 12 from the molten-steel flow holes 17. The molten steel L poured into the mold 2 is cooled to form a solidification shell 6, and onto a molten steel surface 7 in the mold 2, a mold powder 8 is added.

In a first embodiment of the present invention, at least a part of the immersion nozzle 1 is formed of a refractory having a function of preventing $Al_2O_3$ deposition, in which the refractory is formed of a refractory material such as MgO and a metal such as Al. In a first example shown in a schematic cross-sectional view of FIG. 3, except for a slag line portion 24 which is to be brought into contact with slag, the immersion nozzle 1 is totally formed of a refractory 22 having the function of preventing $Al_2O_3$ deposition as described above (hereinafter referred to as "one-piece type"). In addition, in a second example shown in a schematic cross-sectional view of FIG. 4, except for the slag line portion 24, in the immersion nozzle 1, only a peripheral portion of a molten-steel introducing port 25 is formed of the refractory 22 having a desulfurizing ability, and the outside thereof is formed of a mother refractory (supporting refractory) 23 (hereinafter referred to as "insertion type").

As the refractory 22, in particular, a material may be used which is formed of a refractory material including an oxide which contains an alkaline earth metal and a component reducing an oxide. In this case, the oxide containing an alkaline earth metal is preferably composed of MgO as a primary component, and the component reducing an oxide is preferably at least one metal selected from the group consisting of Al, Ti, Zr, Ce, and Ca. In addition, the refractory 22 may further contain carbon. As a typical refractory, for example, there may be mentioned a refractory formed of an Al metal and a refractory material including MgO or a refractory formed of the above refractory and carbon. In addition, it is preferable that the content of the MgO be 5 to 75 mass percent, the content of said at least one metal selected from the group consisting of Al, Ti, Zr, Ce, and Ca be 15 mass percent or less, and in the case in which carbon is contained, the content of the carbon be 40 mass percent or less. Furthermore, in addition to MgO, the refractory 22 preferably contains a small amount of CaO, such as 5 mass percent or less, as a refractory material. In addition, as a refractory material forming the refractory 22, besides MgO and Cao, at least one selected from the group consisting of $Al_2O_3$, $SiO_2$, $ZrO_2$, and $TiO_2$ may be contained.

In addition, as the refractory 22, a material may be used which is formed of a refractory material including spinel ($MgO.Al_2O_3$) and at least one metal selected from the group consisting of Al, Ti, Zr, Ce, and Ca. In addition, carbon may be further contained in the material described above. In addition, it is preferable that the content of the spinel ($MgO.Al_2O_3$) be 20 to 99 mass percent, the content of said at least one metal selected from the group consisting of Al, Ti, Zr, Ce, and Ca be 10 mass percent or less, and in the case in which carbon is contained, the content of the carbon be 40 mass percent or less. Furthermore, in addition to spinel ($MgO.Al_2O_3$), the refractory 22 more preferably contains a small amount of CaO, such as 5 mass percent or less, as a refractory material. In addition, besides spinel ($MgO.Al_2O_3$) and CaO, in order to obtain the heat shock resistance and to improve the high temperature strength, as a refractory material forming the refractory 22, at least one selected from the group consisting of MgO, $Al_2O_3$, $SiO_2$, $ZrO_2$, and $TiO_2$ may be contained.

Figure 3:
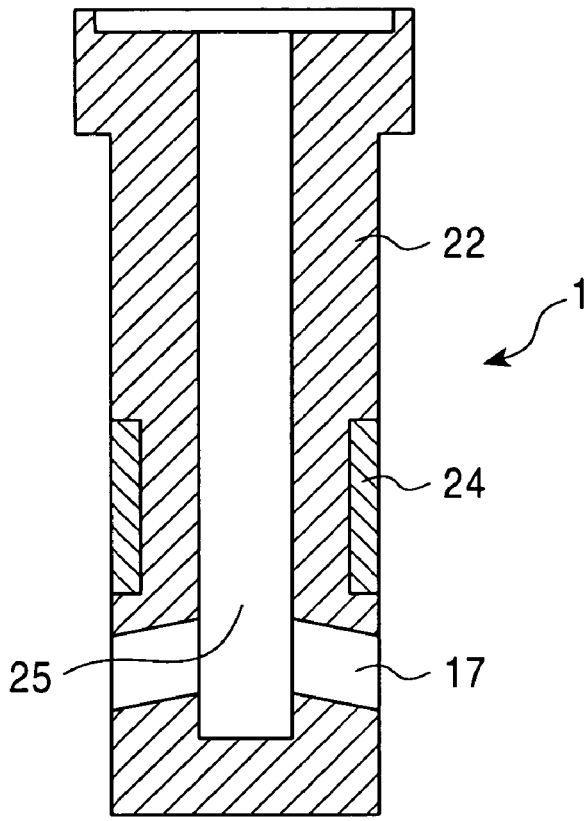
FIG. 3(*a*) is a vertical cross-sectional view schematically showing one example of an immersion nozzle of a first embodiment according to the present invention.
Figure 3:
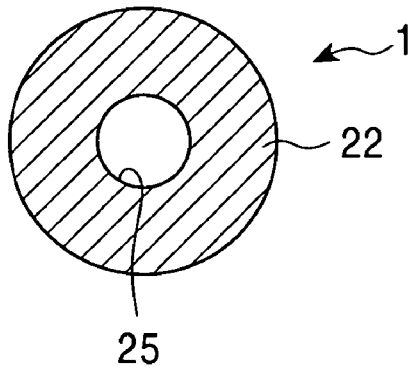

In general, immersion nozzles used for steel continuous casting are formed of an $Al_2O_3$-graphite base refractory or an $Al_2O_3$—$SiO_2$-graphite base refractory, which have superior high temperature strength, in many cases, and hence as the mother refractory 23 shown in FIG. 3 which is defined in the present invention to be used outside of the refractory 22, an $Al_2O_3$-graphite base refractory or an $Al_2O_3$—$SiO_2$-graphite base refractory is preferably used.

In addition, as the slag line portion 24 provided in the region which is brought into contact with a mold powder, a material having superior corrosion resistance against slag, such as a $ZrO_2$-graphite base refractory, may be used. In the immersion nozzle 1 of the present invention, the slag line portion 24 is not always necessary to be provided; however, in consideration of durability of the immersion nozzle 1, the slag line portion 24 is preferably provided.

In particular, when the refractory 22 having a function of preventing $Al_2O_3$ deposition as described above is a refractory having a desulfurizing ability, an S concentration of molten steel in the vicinity of the boundary layer between the inner wall surface of the immersion nozzle and the molten steel is decreased, and repulsion of $Al_2O_3$ particles occurs, thereby obtaining a superior function of preventing $Al_2O_3$ deposition.

Next, a second embodiment will be described.

In the second embodiment of the present invention, the immersion nozzle 1 is formed to be able to inject at least one gas of Mg, Ca, Mn, and Ce from the inner wall surface, and by this structure, the function of preventing $Al_2O_3$ deposition can be obtained. In addition, since the immersion nozzle 1 is formed of a refractory material and at least one powdered metal of Mg, Ca, Mn, and Ce, and at least one gas of Mg, Ca, Mn, and Ce generated from the above powdered metal by heat of molten steel is supplied to the molten steel flowing through the molten-steel introducing port, the function of preventing $Al_2O_3$ deposition can be obtained.

Figure 5:
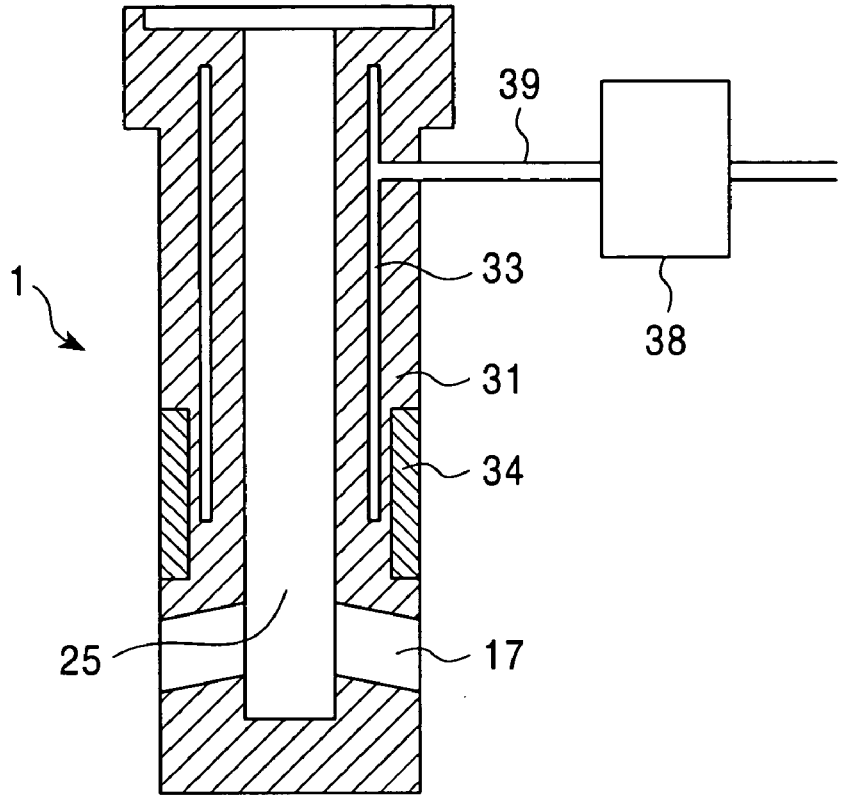
FIG. 5 is a vertical cross-sectional view schematically showing one example of an immersion nozzle of a second embodiment according to the present invention.

FIG. 5 is a schematic cross-sectional view showing an example of the former described above. In the immersion nozzle 1, a slit 33 is provided in a sidewall portion of a mother refractory 31, a gas introduction tube 39 is connected to the slit 33 for supplying at least one gas of Mg, Ca, Mn, and Ce together with an inert gas such as an Ar gas used as a carrier gas, and this gas introduction tube 39 is connected to a gas generator 38 for generating the gas mentioned above. The gas generator 38 is a device in which Mg, Ca, Mn, and Ce metals are gasified by heating using a heater unit or the like, and the gas introduction tube 39 is heated around the periphery thereof for thermal insulation by a heater unit such as a nichrome wire in order to prevent the gas flowing inside the gas introduction tube 39 from being liquidized and solidified. The gas generator 38 contains at least one metal of Mg, Ca, Mn, and Ce and heats it to the melting point thereof or above, thereby generating metal vapor. The metal vapor thus generated is introduced into the slit 33 through the gas introduction tube 39 using an inert gas such as an Ar gas as a carrier gas. As described above, while the molten steel L is being cast, the metal gas introduced into the slit 33 is injected into the molten-steel flow hole 25 from the inner wall surface by the difference in pressure generated by the molten steel L flowing down inside the molten-steel flow hole 25 of the immersion nozzle 1.

As the mother refractory 31 forming the immersion nozzle 1, an $Al_2O_3$-graphite base refractory, an MgO-spinel base refractory, and a spinel base refractory, which have superior high temperature strength, can be preferably used. The thickness of the slit 33 is preferably in the range of from 0.5 to 3 mm. When the thickness is less than 0.5 mm, the slit 33 is liable to be blocked with a high probability due to solidification of a metal gas. On the other hand, when the thickness is more than 3 mm, the nozzle strength tends to decrease, and as a result, a breakage accident of the immersion nozzle 1 may occur in some cases. In addition, as a slag line portion 34 provided in the region brought into contact with the mold powder 8, a material having superior corrosion resistance against slag, such as a $ZrO_2$-graphite base refractory, may be used. The slag line portion 34 is not always necessary to be provided; however, in consideration of durability of the immersion nozzle 1, the slag line portion 34 is preferably provided.

Figure 6:
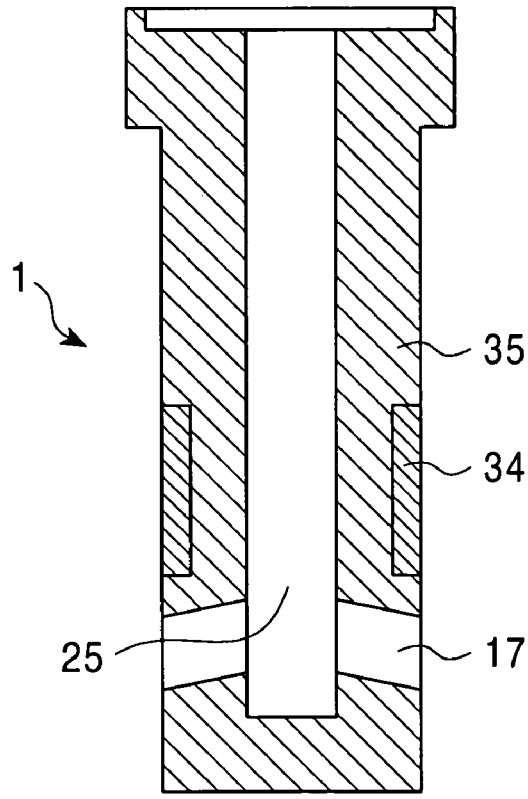
FIG. 6 is a vertical cross-sectional view schematically showing another example of the immersion nozzle of the second embodiment according to the present invention.
Figure 7:
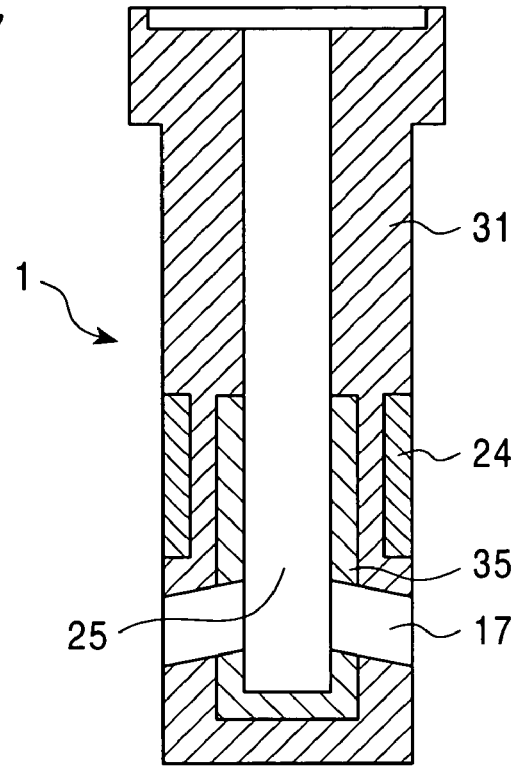
FIG. 7 is a vertical cross-sectional view schematically showing still another example of the immersion nozzle of the second embodiment according to the present invention.
Figure 8:
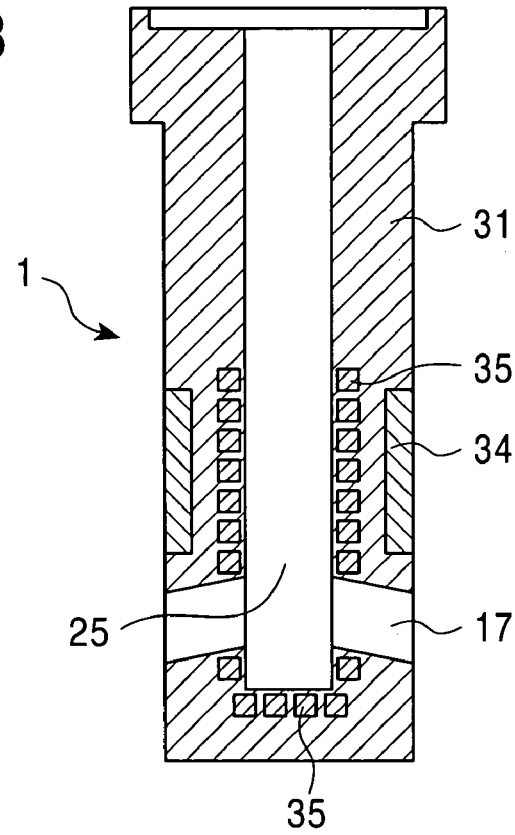
FIG. 8 is a vertical cross-sectional view schematically showing still another example of the immersion nozzle of the second embodiment according to the present invention.

FIGS. 6 to 8 show an example of the latter, that is, the example is shown in which the immersion nozzle 1 is formed of a refractory material and at least one powdered metal of Mg, Ca, Mn, and Ce. In casting of the molten steel L, when the immersion nozzle 1 is heated by heat of the molten steel L, the powdered metal contained in the immersion nozzle 1 is also heated to the melting point thereof or above and is gasified. Accordingly, said at least one gas of Mg, Ca, Mn, and Ce thus generated is injected into the molten-steel introducing port 25 from the inner wall surface of the immersion nozzle 1 by the difference in pressure generated by the molten steel L flowing down through the molten-steel introducing port 25.

According to the example shown in FIG. 6, except for the slag line portion 34, the immersion nozzle 1 is a one-piece type immersion nozzle which is totally composed of a powdered metal-containing refractory 35 which is a mixture formed of at least one powdered metal of Mg, Ca, and Ce and an $Al_2O_3$-graphite base, an MgO-spinel base, or a spinel base refractory material. In addition, according to the example shown in FIG. 7, the immersion nozzle 1 is an insertion type immersion nozzle in which, except for the slag line portion 34, the powdered metal-containing refractory 35 only forms a peripheral portion of the molten-steel introducing port 25 through which molten steel flows, and in which the other parts outside thereof are formed of the mother refractory 31 described above. Furthermore, according to the example shown in FIG. 8, the immersion nozzle 1 (hereinafter referred to as a "composite type") is formed in which the powdered metal-containing refractory 35 is dispersed and embedded in the mother refractory 31 at the inner wall surface side thereof.

In the case described above, the size of the powdered Mg metal, powdered Ca metal, powdered Mn metal, and powdered Ce metal is preferably 0.1 to 3 mm, and the content thereof in the immersion nozzle is preferably 3 to 10 mass percent. When the size of the powdered metal is less than 0.1 mm, the gasification reaction intensively occurs for a very short period of time, and hence it is difficult to generate the metal gas for a long period of time, and on the other hand, when the size is more than 3 mm, in addition to slow gasification reaction, the properties of the refractory may be degraded in some cases when the powdered metal is compounded with the refractory material. In addition, when the content of the powdered metal is less than 3 mass percent, the amount of the generated metal gas is small, and as a result, a desired effect cannot be obtained. On the other hand, when the content is more than 10 mass percent, the properties of the refractory may be degraded in some cases.

In the second embodiment described above, since Mg, Ca, Mn, and Ce are regarded as a metal having an affinity to sulfur and are also considered to have a desulfurizing ability of desulfurizing molten steel by reaction with sulfur contained therein, in the example of the former, the mechanism of preventing $Al_2O_3$ deposition can be construed such that by injecting a gas having a desulfurizing ability from the inner wall surface of the immersion nozzle 1, part of the molten steel flowing through the molten-steel introducing port, which is present at the inner wall surface portion thereof, is desulfurized. In addition, in the example of the latter, the mechanism of preventing $Al_2O_3$ deposition can be construed as follows. That is, by the immersion nozzle 1 formed of the refractory material and the powdered metal having a desulfurizing ability, a gas having a desulfurizing ability is generated from the powdered metal by heat of molten steel, and part of the molten steel flowing through the molten-steel introducing port, which is present at the inner wall surface portion described above, is desulfurized.

When steel continuous casting is performed by the continuous casting machine shown in FIG. 2 using the immersion nozzle 1 as described in the first and the second embodiments, the molten steel L poured from a ladle (not shown) into the tundish 3 is supplied into the mold 2 from the molten-steel discharge holes 17 of the immersion nozzle 1 through the molten-steel flow hole 16 while the flow rate of the molten steel is controlled by the sliding nozzle 5, in which the molten-steel stream 18 is directed toward the mold short copper plates 12. The molten steel L thus poured is cooled in the mold 7 to form the solidification shell 13 and is then continuously drawn out to the downside of the mold 7, thereby forming a cast steel strand. In casting, the mold powder 8 is added onto the molten steel surface 7 in the mold 2.

In this case, the molten steel L may be aluminum killed steel which is deoxidized by Al in many cases, and although $Al_2O_3$ particles are suspended in the molten steel, by using the immersion nozzle 1 as described above, $Al_2O_3$ particle deposition can be prevented.

When the refractory 22 of the first embodiment has a desulfurizing ability, or as is the case of the second embodiment, when a metal gas having a desulfurizing ability is supplied to molten steel flowing through the molten-steel introducing port 25 of the immersion nozzle 1, part of the molten steel L flowing through the molten-steel introducing port 25 of the immersion nozzle 1, which is present at the inner wall surface portion, is desulfurized so as to have a low S concentration, and the S concentration of molten steel present at the central side of the molten-steel introducing port 25, which is apart from the inner wall surface, becomes relatively high, resulting in generation of the difference in surface tension between the molten steel L and $Al_2O_3$ particles. Due to this difference in surface tension, since the $Al_2O_3$ particles suspended in the molten steel L move from the inner wall surface of the immersion nozzle 1 to the direction opposite thereto, the thickness growth of an $Al_2O_3$ deposition layer on the inner wall surface of the immersion nozzle 1 is suppressed, and hence the nozzle is prevented from being blocked by $Al_2O_3$. As a result, the time for performing casting can be significantly increased, and in addition, the formation of coarse and large $Al_2O_3$ particles can be prevented which is caused by the deposition and accumulation thereof on the inner wall surface of the immersion nozzle 1. Consequently, the formation of large inclusions in cast steel strands caused by peeling of coarse and large $Al_2O_3$ can be remarkably reduced.

Heretofore, from one of the upper nozzle 4, the fixing plate 13 of the sliding nozzle 5, and the immersion nozzle 1, or from at least two thereof, an Ar gas is fed into the molten steel L flowing down through the molten-steel flow hole 16 in order to prevent the $Al_2O_3$ deposition; however, when the immersion nozzle 1 according to the present invention is used, since the deposition of $Al_2O_3$ particles hardly occurs as described above, an Ar gas is not necessary to be fed for preventing the $Al_2O_3$ deposition. Even if the feed of an Ar gas is performed, an extremely small amount thereof may be sufficient. For example, when molten steel to be processed by continuous casting is Al-killed steel containing no Ca, continuous casting can be performed at an Ar gas flow rate of 3 NL/min or less (including 0) into the immersion nozzle 1. As described above, when an Ar gas is not fed or the amount thereof is decreased, defects of products generated at the surface portions of cast steel strands, caused by the feed of Ar, can be significantly reduced.

In addition, when molten steel is supplied into the mold through the immersion nozzle 1, the flow control is performed by the sliding nozzle 5 in the case shown in FIG. 2 or is performed by a stopper when it is provided so that the cross-sectional area of the immersion nozzle 1 at a position in the longitudinal direction thereof is decreased, that is, the flow control is performed by decreasing the cross-sectional area of the sliding nozzle portion or that of the stopper portion smaller than that of the immersion nozzle 1. Accordingly, the pressure in the molten-steel introducing port 25 of the immersion nozzle 1 through which molten steel flows down at a high speed is surely reduced and becomes lower than the atmospheric pressure. Since the porosity of the refractory forming the immersion nozzle is approximately 10 to 20%, an Mg gas or the like generated inside the refractory of the immersion nozzle 1 diffuses through the sidewall of the immersion nozzle 1 and reaches the inner wall surface thereof. In order to enable an Mg or a Ca gas generated in the immersion nozzle 1 to reach the interface between the nozzle wall and the molten steel by permeation, it is important to decrease the pressure at the interface as low as possible.

The speed Q ($m^3/sec \cdot m^2$) of the gas passing through the refractory forming the immersion nozzle 1 is proportional to the difference in pressure ΔP (=Pin−Pintf, where Pinft indicates a pressure at the inner wall surface of the refractory, and Pin is a pressure of a gas generated inside the immersion nozzle). In the above equation, the Pintf depends on the degree of opening of the sliding nozzle. In addition, the pressure of fluid flowing through a tube can be represented by the following equation (4), in which a part of the cross-sectional area of the tube is increased and decreased.

$$\frac{\Delta P}{\rho g} = \left(1 - \frac{A_1}{A_2}\right)^2 \frac{v_1^2}{2g} \tag{4}$$

In the above equation, $A_1$ and $A_2$ are cross-sectional areas ($m^2$) of the sliding nozzle and the immersion nozzle, respectively, and the degree of opening OAR of the sliding nozzle is represented so that OAR (%)=$(A_1/A_2)\times 100$. In addition, g indicates gravitation acceleration, and $v_1$ indicates a linear velocity of a molten-steel stream from the sliding nozzle to the immersion nozzle. When a molten steel depth $h_1$ in the tundish is 1.3 m, ΔP calculated from the equation (4) is 0.56 atm at a degree of opening of 20% (in which $v_1=(2gh_1)^{1/2}=(2\times9.8\times1.3)^{1/2}=5.05$ m).

As a basic experiment, the change in permeation speed of a gas was tested by changing the pressure inside the chamber. ΔP corresponding to a degree of opening of 70% was 0.08 atm, the permeation speed of an Mg gas was small, and the effect of preventing alumina deposition was difficult obtained. When the difference in pressure ΔP was set to 0.35 atm or more, the gas permeation became enough, and as a result, the effect of preventing alumina deposition could be obviously obtained. Accordingly, the difference in pressure ΔP is preferably set to 0.35 atom or more. The degree of opening to obtain a difference in pressure of 0.35 atm is 55%.

From the above equation (4), in order to increase the difference in pressure, the degree of opening may be decreased so as to increase the flow velocity; however, when the degree of opening is excessively decreased, it becomes difficult to control the flow volume, and hence the lower limit of the control in practice is approximately 20%. In addition, in order to increase the flow speed, the molten steel depth h1 in a tundish may be increased; however, the shape of a tundish is determined in consideration of suitable casting operation, and the depth is approximately 0.5 to 2 m in many cases.

In the above embodiments, the mold 2 has been described to form a cast steel strand having a rectangular cross-section; however, even when a mold forming a cast steel strand having a round cross-section, the method of the present invention can be applied thereto. Furthermore, the individual devices of the continuous casting machine are not limited to those described above. For example, as is the case in which the stopper may be used instead of the sliding nozzle 5 as a device for adjusting the flow volume of molten steel, any type of device may be used as long as the function thereof is equivalent to that described above.

EXAMPLES

Example 1

At least one metal selected from the group consisting of Al, Ti, Zr, Ce, and Ca, which was a component of reducing MgO, was compounded with a refractory material including an oxide containing MgO, thereby forming various refractory compositions indicated by Nos. 1 to 19 shown in Table 1. The refractory compositions thus formed were each used as the refractory 22 shown in FIG. 3 or 4, and were formed into immersion nozzles having the shapes shown in FIG. 3 or 4. By using the immersion nozzles thus formed, continuous casting of molten steel was performed using the continuous casting machine shown in FIG. 2. In the case of the insertion type immersion nozzle shown in FIG. 4, an $Al_2O_3$-graphite base refractory was used as a mother refractory which was provided around the outside periphery of the immersion nozzle. In addition, for purposes of comparison, casting was also performed using an immersion nozzle made of a conventional $Al_2O_3$-graphite base refractory indicated by Nos. 20 and 21.

After 6 heats, in which 300 ton was per one heat, were continuously processed by casting, the immersion nozzle used in this process was recovered, and deposits on the inner wall right above the discharge hole were observed. The type of cast steel was low-carbon aluminum-killed steel (C: 0.04 to 0.05 mass percent, Si: trace, Mn: 0.1 to 0.2 mass percent, and Al: 0.03 to 0.04 mass percent), and the slab width was in the range of from 950 to 1,200 mm. The drawing speed of cast steel strand was 2.2 to 2.8 m/min.

By observation of the deposits, the following evaluation was performed. That is, a state in which $Al_2O_3$ deposition was very small (a thickness of 5 mm or less) and bare steel deposited and accumulated on the inner wall surface of the immersion nozzle was not observed at all was categorized as "no deposition" (represented by ⊙); a state in which the $Al_2O_3$ deposition thickness was in the range of from more than 5 to 10 mm and bare steel deposited and accumulated on the inner wall surface of the immersion nozzle was not present was categorized as "small deposition" (represented by ○); a state in which the $Al_2O_3$ deposition thickness was in the range of from more than 10 to 20 mm and bare steel deposited and accumulated was present was categorized as "medium deposition"; and, in addition, a state in which the $Al_2O_3$ deposition thickness was more than 20 mm and a large amount of bare steel was deposited and accumulated on the inner wall surface of the immersion nozzle was categorized as "large deposition" (represented by x). In Table 1, the refractory compositions used for this evaluation and the evaluation results of $Al_2O_3$ deposition states are shown.

TABLE 1

| | Refractory composition of immersion nozzle (mass %) | | | | | | | | | Type of | State of $Al_2O_3$ |
|---|---|---|---|---|---|---|---|---|---|---|---|
| No. | MgO | $Al_2O_3$ | C | $SiO_2$ | Al | Ti | Zr | Ce | Ca | nozzle | deposition |
| 1 | 54 | 17 | 24 | — | 5 | — | — | — | — | One-piece type | ⊙ |
| 2 | 67 | 23 | — | — | 10 | — | — | — | — | Insertion type | ⊙ |
| 3 | 54 | 17 | 24 | — | — | 5 | — | — | — | Insertion type | ⊙ |
| 4 | 54 | 17 | 24 | — | — | — | 5 | — | — | One-piece type | ⊙ |
| 5 | 54 | 17 | 24 | — | — | — | — | 5 | — | Insertion type | ⊙ |
| 6 | 54 | 17 | 24 | — | — | — | — | — | 5 | One-piece type | ⊙ |
| 7 | 52 | 16 | 22 | — | 5 | — | 5 | — | — | Insertion type | ⊙ |
| 8 | 52 | 16 | 22 | — | 5 | — | — | 5 | — | One-piece type | ⊙ |
| 9 | 54 | 17 | 24 | — | 5 | — | — | — | 5 | Insertion type | ⊙ |
| 10 | 75 | 0 | 20 | — | 5 | — | — | — | — | Insertion type | ⊙ |
| 11 | 5 | 65 | 25 | — | 5 | — | — | — | — | Insertion type | ⊙ |
| 12 | 80 | 0 | 15 | — | 5 | — | — | — | — | Insertion type | ⊙ |
| 13 | 58 | 17 | 24 | — | 1 | — | — | — | — | Insertion type | Δ-○ |
| 14 | 57 | 17 | 24 | — | 2 | — | — | — | — | Insertion type | ○ |
| 15 | 54 | 17 | 24 | — | 5 | — | — | — | — | Insertion type | ⊙ |
| 16 | 49 | 17 | 24 | — | 10 | — | — | — | — | Insertion type | ⊙ |
| 17 | 44 | 17 | 24 | — | 15 | — | — | — | — | Insertion type | ⊙ |
| 18 | 45 | 10 | 40 | — | 5 | — | — | — | — | Insertion type | ⊙ |
| 19 | 40 | 10 | 45 | — | 5 | — | — | — | — | Insertion type | ⊙ |
| 20 | — | 50 | 28 | 22 | — | — | — | — | — | One-piece type | X |
| 21 | 4 | 46 | 28 | 22 | — | — | — | — | — | One-piece type | X |

As can also be seen from Table 1, according to the results of Nos. 20 and 21 of comparative examples, since the amount of $Al_2O_3$ deposition was large and a large amount of bare steel was deposited and accumulated on the inner wall surface of the immersion nozzle, the evaluation was "large deposition". On the other hand, according to the results of Nos. 1 to 19 of the present invention in which the immersion nozzles was formed of the refractory which was composed of a refractory material including an oxide containing MgO and at least one metal selected from the group consisting of Al, Ti, Zr, Ce, and Ca which was a component reducing MgO, the amount of $Al_2O_3$ deposition and the amount of bare steel deposition were small as compared to that of the comparative examples. Among those described above, the results of Nos. 1 to 12 and 15 to 19, in which the content of the MgO was 5 to 75 mass percent and that of the reducing component such as Al was 5 to 15 mass percent, were remarkably superior and categorized as "no deposition" represented by ⊙. The result of No. 14 in which the amount of Al was 2 mass percent was categorized as "small deposition" represented by ○ since the $Al_2O_3$ deposition was slightly inferior to that of the samples described above, and the result of No. 13 in which the amount of Al was 1 mass percent was categorized between "medium deposition" and "small deposition" represented by Δ-○ since the effect was small in some cases depending on casting chances. That is, the effect of suppressing $Al_2O_3$ deposition could be confirmed when the amount of Al is 1 mass percent or more. However, it was also confirmed that in order to stably obtain the effect of suppressing $Al_2O_3$ deposition, the amount of Ai is preferably 2 mass percent or more, and that in order to reliably prevent $Al_2O_3$ deposition, the amount of Ai is preferably 5 to 15 mass percent or more. The result of No. 17, in which the content of the Al was 15 mass percent, on the evaluation of $Al_2O_3$ deposition was remarkably superior and categorized as "no deposition" represented by ⊙; however, cracking occurred in the inner surface of the immersion nozzle in some cases. Accordingly, in view of the effect of suppressing $Al_2O_3$ deposition on the inner wall and of the stability of materials, it was concluded that the most preferable result can be obtained when the content of the Al is set to 5 to 10 mass percent. In addition, the result of No. 12, in which the content of the MgO was 80 mass percent, on the evaluation of $Al_2O_3$ deposition was remarkably superior and categorized as "no deposition" represented by ⊙; however, cracking occurred in the inner surface of the immersion nozzle in some cases. Accordingly, it was confirmed that the content of the MgO is preferably in the range of from 5 to 75 mass percent. Furthermore, when the content of the carbon was 40% or less, the insertion type immersion nozzle could be placed in a sound state. However, according to the result of No. 19 in which the content of the carbon was 45 mass percent, peeling occurred at an adhesion part of the insertion type immersion nozzle in some cases. Accordingly, when carbon was contained, it was confirmed that the content thereof is preferably 40 mass percent or less.

Example 2

Figure 4:
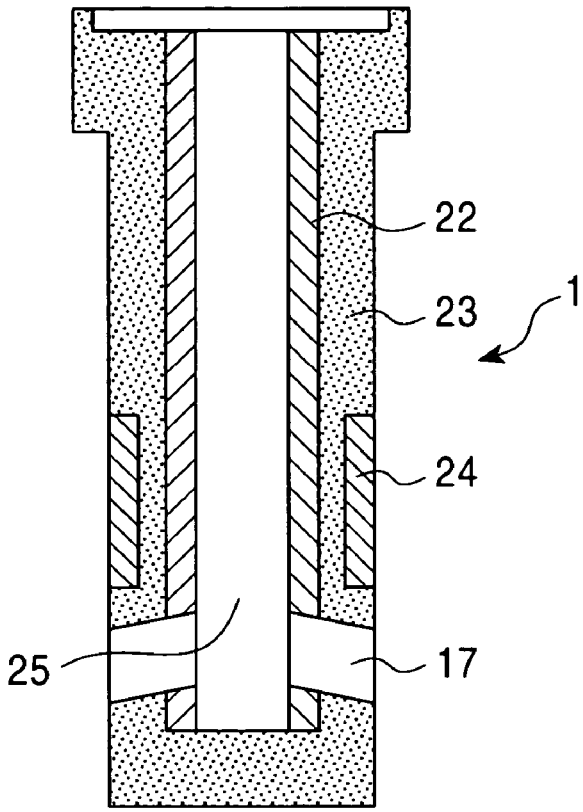
FIG. 4(*a*) is a vertical cross-sectional view schematically showing another example of the immersion nozzle of the first embodiment according to the present invention.
Figure 4:
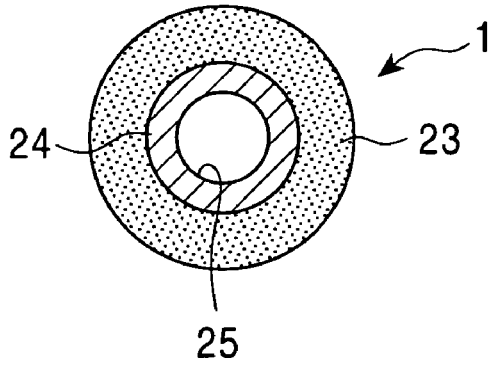

As shown in Table 2, No. 22 having the same composition as that of No. 1 shown in Table 1 was regarded as a basic composition, and by using refractories having compositions of Nos. 23 to 26, each having the basic composition described above and CaO contained therein, as the refractory 22 shown in FIG. 4, the insertion type immersion nozzle shown in FIG. 4 was formed. Subsequently, by using this immersion nozzle, molten steel was processed by continuous casting using the continuous casting machine shown in FIG. 2.

After 8 heats, in which 300 ton was per one heat, were continuously processed by casting, the immersion nozzle used in this process was recovered, and deposits on the inner wall right above the discharge hole and the state of the immersion nozzle were observed. The type of cast steel was low-carbon aluminum-killed steel (C: 0.04 to 0.05 mass percent, Si: trace, Mn: 0.1 to 0.2 mass percent, and Al: 0.03 to 0.04 mass percent), and the slab width was in the range of from 950 to 1,200 mm. The drawing speed of cast steel strand was 2.2 to 2.8 m/min.

By observation of the deposits, the following evaluation was performed. That is, a state in which the $Al_2O_3$ deposition thickness was 5 mm or less and cracks were not observed at all was categorized as "significantly good" (represented by ⊙); a state in which the $Al_2O_3$ deposition thickness was in the range of from more than 5 to 10 mm and cracks were not observed at all was categorized as "good" (represented by ○); a state in which the $Al_2O_3$ deposition thickness was in the range of from more than 10 to 15 mm or minute cracks were generated was categorized as "no good" (represented by Δ); and a state in which the $Al_2O_3$ deposition thickness was more than 15 mm or cracks were generated, or a state in which the nozzle could not be adequately used by another reason was categorized as "inadequate" (represented by x).

TABLE 2

| No. | MgO | $Al_2O_3$ | Metal Al | CaO | C | Alumina deposition | Impact resistance | Evaluation |
|---|---|---|---|---|---|---|---|---|
| 22 | 54 | 17 | 5 | — | 24 | 10 | No cracks | ○ |
| 23 | 53.5 | 17 | 5 | 0.5 | 24 | 8 | No cracks | ○ |
| 24 | 53 | 17 | 0 | 1 | 24 | 5 | No cracks | ⊙ |
| 25 | 51 | 17 | 5 | 3 | 24 | <5 | No cracks | ⊙ |
| 26 | 49 | 17 | 5 | 5 | 24 | <5 | No cracks | ⊙ |

As shown in Table 2, No. 23 in which the amount of CaO was 0.5 mass percent was evaluated as "good" represented by ○ as was the case of No. 22 having the basic composition, and the $Al_2O_3$ deposition thickness was slightly small as compared to that of No. 22. However, Nos. 24 to 26 in which the amount of CaO was 1 to 5 mass percent were evaluated as "significantly good" represented by ⊙. Accordingly, it was confirmed that when the amount of CaO is 1 to 5 mass percent, the effect of preventing $Al_2O_3$ deposition is significantly improved.

Example 3

A continuous casting machine (two-strand type machine) having the mold portion as shown in FIG. 2 was used, and for one strand, the immersion nozzle of the present invention was used. That is, in the immersion nozzle mentioned above, as shown in FIG. 7, a refractory composed of an MgO-carbon-Al metal base material containing $Al_2O_3$ and CaO was lined at the inside hole side including the discharge hole, and the outside thereof was supported by an $Al_2O_3$-graphite base refractory. As the refractory composed of an MgO-carbon-Al metal base material containing $Al_2O_3$ and CaO, of the present invention, a material was used which was composed of 25 mass percent of powdered $Al_2O_3$, 5 mass percent of powdered CaO, and a mixture obtained by mixing a powdered magnesia clinker having a particle diameter of 3 mm or less, powdered carbon having a particle diameter of 0.5 mm or less, and a powdered Al metal having a particle diameter of 0.1 to 3 mm at a mixing ratio of 4:2:1. First, MgO, graphite, and an Al metal were mixed together, so that Al metal was disposed around MgO as close as possible. The reason for this is to efficiently generate an Mg gas by reaction between MgO and Al. The reason $Al_2O_3$ was contained is to improve strength by forming a spinel by reaction with MgO. Calcium was not added to molten steel at all, an Ar gas flow was not fed for first two charges at all, and an Ar gas was fed at a flow rate of 3 Nl/min for last two charges.

For the other strand, a conventional $Al_2O_3$—C base immersion nozzle was used. For this strand, an Ar gas was fed at a flow rate of 10 NL/min from the beginning to the end.

Casting was performed by adjusting the molten-steel depth in a tundish in the range of from 0.7 to 2 m. The degree of opening of the sliding nozzle and the immersion nozzle was controlled in the range of from 20% to 70% when the drawing speed was constant. For example, when the depth h1 of molten steel in a tundish was 1.3 m, in order to have a degree of opening of 20%, 40%, 55%, and 60%, the casting through-put amount (ton/min) was 3.6, 5.1, 6.0, and 6.3 ton/min, respectively. By forming the conversion table as described above, casting was performed.

The type of cast steel was low-carbon aluminum-killed steel (C: 0.04 to 0.05 mass percent, Si: trace, Mn: 0.1 to 0.2 mass percent, S: 0.008 to 0.15 mass percent, and Al: 0.03 to 0.04 mass percent), and the slab width was 1,600 mm. The drawing speed of cast steel strand was 1.4 to 2.4 m/min.

For casting, 4 charges, in which 300 ton was per one charge, were continuously cast. The immersion nozzle used in this casting process was recovered, and the deposition layer thickness on the inner wall right above the discharge hole was measured at four points in the width direction of the mold and the direction perpendicular thereto, and the average value thereof was regarded as the deposition layer thickness.

Figure 9:
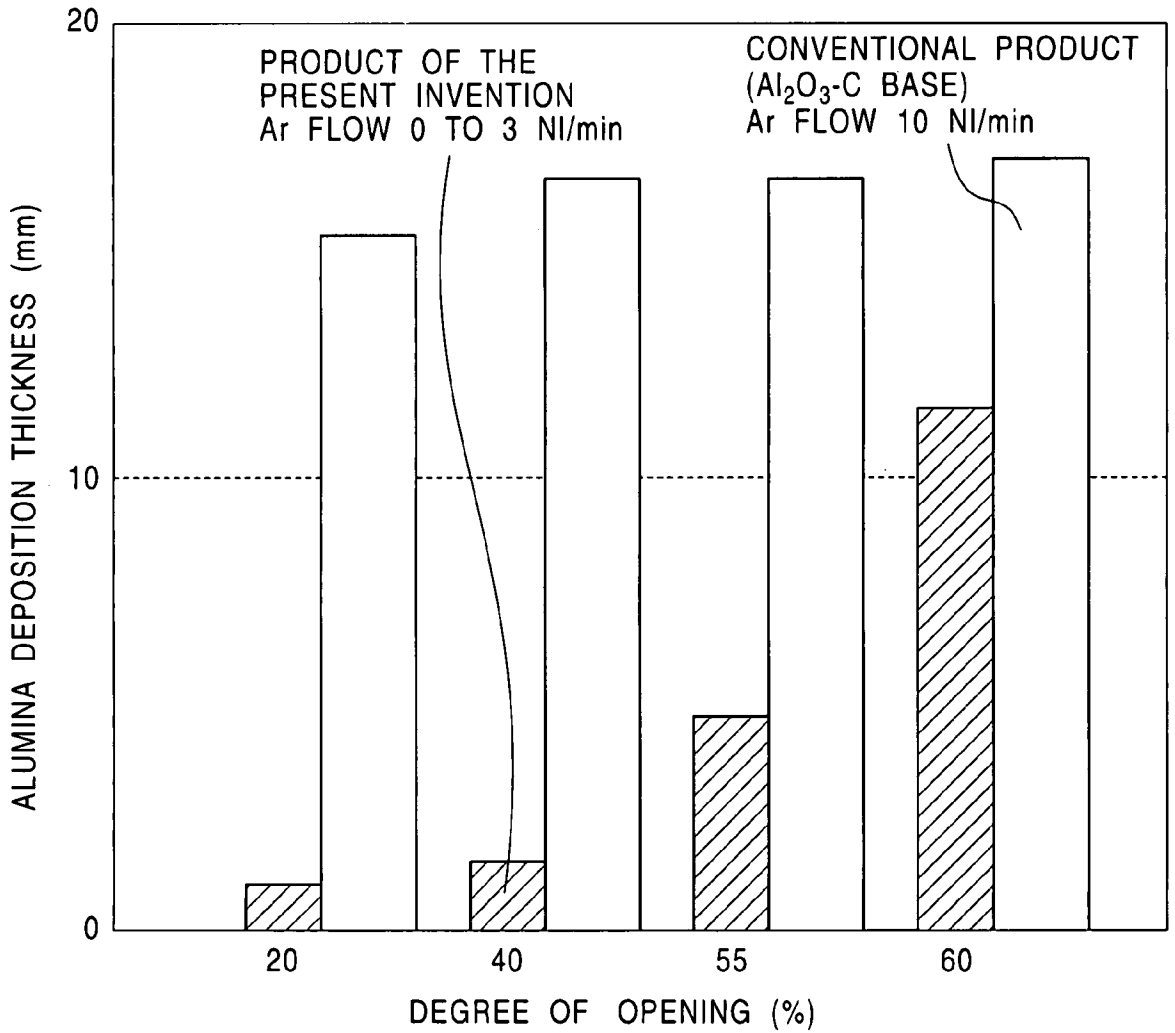
FIG. 9 is a graph showing the relationship between the degree of opening OAR of a sliding nozzle in abscissa and the thickness of alumina deposition on an inner wall of a nozzle in ordinate, in which the data of an immersion nozzle of the present invention and the data of a conventional immersion nozzle are shown for purposes of comparison.

The results are shown in FIG. 9. FIG. 9 is a graph showing the relationship between the degree of opening OAR of the sliding nozzle in abscissa and the alumina deposition thickens on the inner wall of the nozzle in ordinate, in which the data of the immersion nozzle of the present invention and the data of the conventional immersion nozzle are shown for purposes of comparison. As can be seen from this figure, in the case of the immersion nozzle of the present invention, when the OAR is 60%, an $Al_2O_3$ deposition thickness of approximately 5 mm was present; however, when the OAR was 40% and 20%, the $Al_2O_3$ deposition was not substantially present. On the other hand, in the immersion nozzle made of a conventional $Al_2O_3$-graphite base refractory, even though casting was performed while an Ar gas was always fed at a flow rate of 10 NL/min, casting could not be continuously performed at an OAR of 20% and 40%, and in casting for the third and fourth charges, unless the OAR was adjusted to 70% or more, it became difficult to perform casting. The $Al_2O_3$ deposition thickness measured after the immersion nozzle was recovered was large, such as 20 mm or more.

In a cast steel strand obtained by casting using the immersion nozzle of the present invention while an Ar gas was not substantially fed, the number of pinholes was extremely small. When the number of pinholes of a cast steel strand obtained using the conventional immersion nozzle at an Ar gas flow rate of 10 Nl/min was set to be 1, the number of pinholes of the cast steel strand obtained using the immersion nozzle of the present invention was decreased to 0.2 at an Ar gas flow rate of 3 NL/min, and at an Ar gas flow rate of 0 NL/min, the pinholes were not observed at all.

After casting was performed by using the immersion nozzle of the present invention while the Ar gas flow rate to the immersion nozzle was changed from 0 to 10 NL/min, the number of pinholes was measured. When the number of pinholes was se to be 1 at an Ar gas flow rate of 10 Nl/min, 0 at 0 Nl/min, 0.2 at 3 Nl/min, 0.4 at 44 Nl/min, 0.8 at 6 Nl/min, and 0.9 at 8 Nl/min were obtained. Hence, it was understood that in order to suppress the generation of pinholes, the Ar gas flow rate is preferably controlled to be 3 NL/min or less. As described above, when the Ar gas flow rate was decreased, in the case of the conventional alumina-graphite base nozzle, alumina blocking occurred, and after only 1 to 2 charges were processed, the casting is stopped. However, when the immersion nozzle of the present invention was used, even when the Ar gas flow rate was 3 NL/min or less, casting can be performed for 4 charges or more.

When a slab manufactured by this casting was used for forming beverage cans, in the case of a conventional casting method ($Al_2O_3$-graphite base nozzle was used at an Ar gas flow rate of 10 NL/min), the number of defective cans was 20 to 50 out of one million cans, and on the other hand, when a slab was used which was formed by the immersion nozzle of the present invention at an Ar gas flow rate of 3 NL/min or less, the number of defective cans was superior level, such as 10 cans or less. Among the defects of a cast material by the conventional method, 30% was caused by powder, 30% was caused by alumina, and the rest was caused by unknown factors. On the other hand, in the case in which the immersion nozzle of the present invention was used at an Ar gas flow rate of 3 NL/min or less, defects caused by powder was zero, defects caused by alumina was 80%, and the rest was caused by unknown factors.

As described above, the case in which the immersion nozzle of the present invention was used at an Ar gas flow rate of 3 NL/min or less is characterized by that the defects were not caused by powder at all and that the number of surface defects resulting from scales was also significantly reduced.

Experiment 4

At least one metal selected from the group consisting of Al, Ti, Zr, Ce, and Ca was compounded with a refractory material including spinel ($MgO.Al_2O_3$), thereby forming various refractory compositions indicated by Nos. 27 to 38 shown in Table 3. The refractory compositions thus formed were each used as the refractory 22 shown in FIG. 3 or 4, and were formed into immersion nozzles having the shape shown in FIG. 3 or 4. By using the immersion nozzles thus formed, continuous casting of molten steel was performed using the continuous casting machine shown in FIG. 2. In the case of the insertion type immersion nozzle shown in FIG. 4, an $Al_2O_3$-graphite base refractory was used as a mother refractory which was provided around the outside periphery of the immersion nozzle. In addition, for purposes of comparison, casting was also performed using immersion nozzles made of refractories indicated by Nos. 39 and 40 each including a spinel as a structural material and no metal such as an Al metal used as a reducing agent, and a refractory made of a conventional $Al_2O_3$-graphite base refractory indicated by No. 41, those refractories being used as the refractory 22.

After 6 heats, in which 300 ton was per one heat, were continuously processed by casting, the immersion nozzle used in this process was recovered, and deposits on the inside of a slag line portion were observed. The type of cast steel was low-carbon aluminum-killed steel (C: 0.04 to 0.05 mass percent, Si: trace, Mn: 0.1 to 0.2 mass percent, S: 0.01 to 0.02 mass percent, and Al: 0.03 to 0.04 mass percent), and the slab width was in the range of from 950 to 1,200 mm. The drawing speed of cast steel strand was 2.2 to 2.8 m/min.

By observation of the deposits, the following evaluation was performed. That is, a state in which $Al_2O_3$ deposition was very small and bare steel deposited and accumulated on the inner wall surface of the immersion nozzle was not observed at all was categorized as "no deposition" (represented by ○), and on the other hand, a state in which $Al_2O_3$ deposition was large and a large amount of bare steel was deposited and accumulated on the inner wall surface of the immersion nozzle was categorized as "deposition" (represented by x). In Table 2, the refractory compositions and the evaluation results of $Al_2O_3$ deposition states are shown.

TABLE 3

| | Refractory composition of immersion nozzle (mass %) | | | | | | | | | | Type of | State of $Al_2O_3$ |
|---|---|---|---|---|---|---|---|---|---|---|---|---|
| No. | Spinel | Al | Ti | Zr | Ce | Ca | MgO | $Al_2O_3$ | C | $SiO_2$ | nozzle | deposition |
| 27 | 80 | 5 | — | — | — | — | — | 15 | — | — | One-piece type | ○ |
| 28 | 80 | — | 5 | — | — | — | — | 15 | — | — | Insertion type | ○ |
| 29 | 80 | — | — | 5 | — | — | — | 15 | — | — | One-piece type | ○ |
| 30 | 80 | — | — | — | 5 | — | — | 15 | — | — | Insertion type | ○ |
| 31 | 80 | — | — | — | — | 5 | — | 15 | — | — | One-piece type | ○ |
| 32 | 80 | 5 | 5 | — | — | — | — | 10 | — | — | Insertion type | ○ |
| 33 | 30 | 5 | — | — | — | — | 15 | 50 | — | — | One-piece type | ○ |
| 34 | 80 | 5 | — | — | — | — | 15 | — | — | — | Insertion type | ○ |
| 35 | 60 | 5 | — | — | — | — | — | 10 | 25 | — | One-piece type | ○ |
| 36 | 70 | 5 | — | — | — | — | — | — | 25 | — | Insertion type | ○ |
| 37 | 20 | 5 | — | — | — | — | — | 85 | — | — | One-piece type | ○ |
| 38 | 99 | 1 | — | — | — | — | — | — | — | — | Insertion type | ○ |
| 39 | 100 | — | — | — | — | — | — | — | — | — | Insertion type | X |
| 40 | 80 | — | — | — | — | — | — | 20 | — | — | One-piece type | X |
| 41 | — | — | — | — | — | — | 4 | 46 | 28 | 22 | One-piece type | X |

As can also be seen from Table 3, according to the results of Nos. 39 to 41 of comparative examples, the amount of $Al_2O_3$ deposition was large and a large amount of bare steel was deposited and accumulated on the inner wall surface of the immersion nozzle. On the other hand, according to the results of Nos. 27 to 38 in which the immersion nozzles were each formed of the refractory which was composed of a refractory material including the spinel ($MgO.Al_2O_3$) and at least one metal selected from the group consisting of Al, Ti, Zr, Ce, and Ca, the amount of $Al_2O_3$ deposition was very small and bare steel deposited and accumulated on the inner wall surface of the immersion nozzle was not observed at all.

Experiment 5

Continuous casting of aluminum-killed molten steel was performed by the continuous casting machine shown in FIG. 2 using the slit type immersion nozzle shown in FIG. 5 while a metal gas was fed into the slit, the metal gas being generated from one metal of Mg, Ca, Mn, and Ce. As the metal gas described above, at least one metal of Mg, Ca, Mn, and Ce was placed in a tube for containing metal of an electric resistance furnace and was then gasified, and the gas thus obtained was introduced into the immersion nozzle. In order to prevent the gas from being solidified, a path from the electric resistance furnace to the immersion nozzle was heated to the melting point of the gas or above and maintained at the temperature. In the case of an MgO metal, experiment was performed at three heating temperatures of the electric resistance furnace, which were 900, 1,000, and 1,100° C. The temperature of a gas conduit pipe used for gas transportation was also maintained at the same temperature as mentioned above. In the case of a Ca metal, heating was performed to 1,000° C. by the electric resistance furnace and the gas conduit pipe was maintained at 1,000° C. or more. In the case of an Mn metal, heating was performed to 1,300° C. by the electric resistance furnace and the gas conduit pipe was maintained at 1,300° C. or more. In the case of a Ce metal, heating was performed to 1,000° C. by the electric resistance furnace and the gas conduit pipe was maintained at 1,000° C. or more. In the immersion nozzle, the mother refractory was formed of an $Al_2O_3$-graphite base refractory. For purposes of comparison, casting was also performed without supplying a metal gas.

After 6 heats, in which 300 ton was per one heat, were continuously processed by casting, the immersion nozzle used in this process was recovered, and the deposition thickness on the inner wall surface above the discharge hole at a distance of 20 mm was measured. The type of cast steel was low-carbon aluminum-killed steel (C: 0.04 to 0.05 mass percent, Si: trace, Mn: 0.1 to 0.2 mass percent, and Al: 0.03 to 0.04 mass percent), and the slab width was in the range of from 950 to 1,200 mm. The drawing speed of cast steel strand was 2.2 to 2.8 m/min.

By observation of the deposits, the following evaluation was performed. That is, a state in which $Al_2O_3$ deposition was very small and bare steel deposited and accumulated on the inner wall surface of the immersion nozzle was not observed at all was categorized as "no deposition" (represented by ○), and on the other hand, a state in which $Al_2O_3$ deposition was large and a large amount of bare steel was deposited and accumulated on the inner wall surface of the immersion nozzle was categorized as "deposition" (represented by x). In addition, a state between the above two states was categorized as "slight deposition" (represented by Δ). In Table 4, the metal gas used for this evaluation, the temperature of the electric resistance furnace, the measurement result of $Al_2O_3$ deposition thickness, and the evaluation results are shown.

TABLE 4

| No. | Type of meal gas | Heating temperature of electric resistance furnace (° C.) | $Al_2O_3$ deposition thickness (mm) | Evaluation |
|---|---|---|---|---|
| 42 | Mg | 1000 | 5 | ○ |
| 43 | Mg | 900 | 15 | Δ |
| 44 | Mg | 1100 | 4 | ○ |
| 45 | Ca | 1000 | 5 | ○ |
| 46 | Mn | 1300 | 5 | ○ |
| 47 | Ce | 1000 | 3.5 | ○ |
| 48 | — | — | 25 | X |

As can also be seen from Table 4, in the case of the conventional casting method (No. 48) in which a metal gas was not fed, the amount of $Al_2O_3$ deposition was large and the evaluation was "deposition". However, when a gas of Mg, Ca, Mn, or Ce was injected from the inner wall surface of the immersion nozzle, compared to the case of the conventional casting method, the amount of $Al_2O_3$ deposition could be reduced. Among the experiments using Mg, 43 in which the temperature of the electric resistance furnace was set to 900° C. was evaluated as "slight deposition"; however, Nos. 42 and 44 in which the temperature was set to 1,000° C. or more were all evaluated as "no deposition".

Example 6

By using the one-piece type immersion nozzle shown in FIG. 6, the insertion type immersion nozzle shown in FIG. 7, and the composite type immersion nozzle shown in FIG. 8, continuous casting of aluminum-killed molten steel was performed by the continuous casting machine shown in FIG. 2. In this example, a refractory was used which was composed of an $Al_2O_3$-graphite base refractory material and a powdered Mg metal, a powdered Ca metal, a powdered Mn metal, or a powdered Ce metal which was mixed with the refractory material and was dispersed therein. The size of the powdered metal was set to 0.1 to 3 mm as the basis, in addition, the content of the powdered metal was set to 5 mass percent as the basis. However, in the case of the powdered Mg metal, experiments in which the size and the content were changed were also carried out. The mother refractory used for the insertion type immersion nozzle was an $Al_2O_3$-graphite base refractory. For purposes of comparison, casting was also performed using a conventional immersion nozzle made of an $Al_2O_3$-graphite refractory material.

After 6 heats, in which 300 ton was per one heat, were continuously processed by casting, the immersion nozzle used in this process was recovered, and the deposition thickness on the inner wall surface above the discharge hole at a distance of 20 mm was measured. The type of cast steel was low-carbon aluminum-killed steel (C: 0.04 to 0.05 mass percent, Si: trace, Mn: 0.1 to 0.2 mass percent, and Al: 0.03 to 0.04 mass percent), and the slab width was in the range of from 950 to 1,200 mm. The drawing speed of cast steel strand was 2.2 to 2.8 m/min.

By observation of the deposits, the following evaluation was performed. That is, a state in which $Al_2O_3$ deposition was very small and bare steel deposited and accumulated on the inner wall surface of the immersion nozzle was not observed at all was categorized as "no deposition" (represented by ○), and on the other hand, a state in which $Al_2O_3$ deposition was large and a large amount of bare steel was deposited and accumulated on the inner wall surface of the immersion nozzle was categorized as "deposition" (represented by x). In addition, a state between the above two states was categorized as "slight deposition" (represented by Δ). In Table 5, the type of immersion nozzle, the type of metal, and the size and content of the powdered metal used for this evaluation; measurement result of $Al_2O_3$ deposition thickness; the evaluation results, and the state of immersion nozzle after the use are shown.

TABLE 5

| No. | Type of nozzle | Type of metal | Size of metal powder (mm) | Content of metal powder (mass %) | $Al_2O_3$ deposition thickness (mm) | Evaluation | State of nozzle |
|---|---|---|---|---|---|---|---|
| 49 | One-piece type | Mg | 0.1-3 | 5 | 4 | ○ | |
| 50 | Insertion type | Mg | 0.1-3 | 5 | 5.5 | ○ | |
| 51 | Composite type | Mg | 0.1-3 | 5 | 6.5 | ○ | |
| 52 | One-piece type | Mg | 1-5 | 5 | 6 | ○ | Peeling |
| 53 | One-piece type | Mg | 0.01-1 | 5 | 15 | Δ | Poor persistence |
| 54 | Insertion type | Mg | 0.1-3 | 2 | 16 | Δ | Poor persistence |
| 55 | Insertion type | Mg | 0.1-3 | 3 | 10 | ○ | |
| 56 | Insertion type | Mg | 0.1-3 | 10 | 5 | ○ | |
| 57 | Insertion type | Mg | 0.1-3 | 15 | 5 | ○ | Peeling |
| 58 | Insertion type | Ca | 0.1-3 | 5 | <5 | ○ | |

TABLE 5-continued

| No. | Type of nozzle | Type of metal | Size of metal powder (mm) | Content of metal powder (mass %) | $Al_2O_3$ deposition thickness (mm) | Evaluation | State of nozzle |
|---|---|---|---|---|---|---|---|
| 59 | Insertion type | Mn | 0.1-3 | 5 | 6 | ○ | |
| 60 | Insertion type | Ce | 0.1-3 | 5 | <5 | ○ | |
| 61 | Conventional type | — | — | — | 23 | X | Large deposition amount |

As can also be seen from Table 5, in the case in which the refractory composed of an $Al_2O_3$-graphite base refractory material and a powdered Mg metal, a powdered Ca metal, a powdered Mn metal, or a powdered Ce metal, which was mixed with the refractory material and was dispersed therein, was used for the immersion nozzle, as compared to the result of the case in which the conventional immersion nozzle (No. 61) was used, the amount of $Al_2O_3$ deposition can be suppressed. In addition, in particular, in the case in which the size of the powdered metal was set to 0.1 to 3 mm and in which the content of the powdered metal was set to 3 to 10 mass percent or was further set to 5 to 10 mass percent, the $Al_2O_3$ deposition was very small, and bare steel deposited and accumulated on the inner wall surface of the immersion nozzle was not observed at all. In addition, when the size of the powdered metal was 3 mm or more (No. 52), and when the content of the powdered metal was more than 10 mass percent (No. 57), peeling was slightly observed on the immersion nozzle after the use, and it was confirmed that the durability is slightly degraded. In addition when a fine powdered metal was used (No. 53), since the powdered metal was totally gasified from the initial to the middle stage of casting, the durability of the effect of preventing $Al_2O_3$ deposition was not good. In addition, when the content of the powdered metal was small (No. 54), the amount of generated gas was small, and as a result, the effect of preventing $Al_2O_3$ deposition was small.

According to the present invention, since the S concentration of molten steel at the inner wall surface portion of the immersion nozzle can be decreased, the growth of an $Al_2O_3$ deposition layer on the inner wall surface of the immersion nozzle can be suppressed, and blocking of the immersion nozzle caused by $Al_2O_3$ can be prevented. As a result, an available casting time can be significantly increased. In addition, defects relating to large inclusions in cast steel strands caused by coarse and large $Al_2O_3$ which is peeled away from the inner wall of the immersion nozzle and defects relating to a mold powder caused by drift of molten steel in the mold resulting from blocking of the immersion nozzle can be significantly reduced, and as a result, the industrial advantages can be effectively obtained.

What is claimed is:

1. A method for continuous casting of steel comprising supplying molten steel into a mold using an immersion nozzle, characterized in that at least a part disposed at an internal portion of the immersion nozzle which is brought into contact with the molten steel is formed of a refractory having a desulfurizing ability, wherein the refractory comprises 15 to 40 mass % of C.

2. The method according to claim 1, wherein the molten steel is poured into the mold without feeding an Ar gas to the molten steel flowing through a molten-steel introducing port of the immersion nozzle.

3. The method according to claim 1, wherein, when the molten steel is an Al-killed steel containing no Ca, continuous casting is performed by feeding an Ar gas into the immersion nozzle at a flow rate of 3 NL/min or less (including 0).

4. A method for continuous casting of steel comprising supplying molten steel into a mold using an immersion nozzle for continuous casting, characterized in that a gas having a desulfurizing ability is supplied into a sidewall portion of the immersion nozzle so as to be injected into a molten-steel introducing port thereof from an inner wall surface or the immersion nozzle, whereby part of the molten steel flowing through the molten-steel introducing port is desulfurized, said part of the molten steel being present at an inner wall surface portion of the immersion nozzle, wherein the gas having a desulfurizing ability is at least one gas selected from the group consisting of Mg gas, Ca gas, Mn gas and Ce gas.

5. A method for continuous casting of steel, comprising supplying molten steel into a mold using an immersion nozzle for continuous casting, characterized in that at least one gas of Mg gas, Ca gas, Mn gas, and Ce gas is supplied into a sidewall portion of the immersion nozzle so as to be injected into a molten-steel introducing port thereof from an inner wall surface of the immersion nozzle, and the gas is supplied to the molten steel flowing through the molten-steel introducing port.

6. A method for continuous casting of steel, comprising supplying molten steel into a mold using an immersion nozzle, characterized in that at least a part disposed at an internal portion of the immersion nozzle which is brought into contact with the molten steel is formed of a refractory which comprises a refractory material including 15 to 40 mass % of C, an oxide and a component to reduce the oxide, the oxide containing an alkaline earth metal.

7. The method according to claim 6, characterized in that the oxide containing an alkaline earth metal primarily comprises MgO, and the component reducing the oxide is at least one metal selected from the group consisting of Al, Ti, Zr, Ce and Ca.

8. The method according to claim 7, characterized in that the content of the MgO in the refractory is 5 to 75 mass percent, and the content of said at least one metal selected from the group consisting of Al, Ti, Zr, Ce and Ca is 15 mass percent or less.

9. The method according to claim 7, characterized in that the oxide containing an alkaline earth element contains CaO.

10. The method according to claim 9, characterized in that the content of the CaO in the refractory is 5 mass percent or less.

11. A method for continuous casting of steel comprising supplying molten steel into a mold using an immersion nozzle, characterized in that at least a part disposed at an internal portion of the immersion nozzle which is brought into contact with the molten steel is formed of a refractory which comprises a refractory material including 15 to 40 mass % of C, MgO and an Al metal.

12. The method according to claim 11, characterized in that the content of the MgO in the refractory is 5 to 75 mass percent, and the content of the Al metal is 1 to 15 mass percent.

13. The method according to claim 12, characterized in that the content of the Al metal in the refractory is 2 to 15 mass percent.

14. The method according to claim 13, characterized in that the content of the Al metal in the refractory is 5 to 10 mass percent.

15. The method according to claim 11, characterized in that the refractory material further includes CaO.

16. The method according to claim 15, characterized in that the content of the CaO in the refractory is 5 mass percent or less.

17. The method according to any one of claims 6, 7 and 11, characterized in that the refractory material further includes at least one compound selected from the group consisting of $Al_2O_3$, $SiO_2$, $ZrO_2$ and $TiO_2$.

18. The method according to claim 9, characterized in that the refractory material further includes at least one compound selected from the group consisting of $Al_2O_3$, $SiO_2$, $ZrO_2$ and $TiO_2$.

19. A method for continuous casting of steel comprising supplying molten steel into a mold using an immersion nozzle, characterized in that at least a part disposed at an internal portion of the immersion nozzle which is brought into contact with the molten steel is formed of a refractory which comprises a refractory material including 15 to 40 mass % of C, spinel ($MgO.Al_2O_3$) and at least one metal selected from the group consisting of Al, Ti, Zr, Ce and Ca.

20. The method according to claim 19, characterized in that the content of the spinel ($MgO.Al_2O_3$) in the refractory is 20 to 99 mass percent, and the content of said at least one metal selected from the group consisting of Al, Ti, Zr, Ce and Ca is 15 mass percent or less.

21. The method according to claim 19, characterized in that the refractory material further includes CaO.

22. The method according to claim 21, characterized in that the content of the CaO in the refractory is 5 mass percent or less.

23. The method according to claim 19, characterized in that the refractory material further includes at least one compound selected from the group consisting of MgO, $Al_2O_3$, $SiO_2$, $ZrO_2$ and $TiO_2$.

24. The method according to any one of claims 6, 7, 11 and 19, characterized in that the refractory material further includes at least one compound selected from the group consisting of MgO, $Al_2O_3$, $SiO_2$, $ZrO_2$ and $TiO_2$, and the refractory is disposed at an internal portion of the nozzle which is brought into contact with the molten steel.

25. The method according to any one of claims 6, 7, 11 and 19, characterized in that the refractory material further includes at least one compound selected from the group consisting of MgO, $Al_2O_3$, $SiO_2$, $ZrO_2$ and $TiO_2$, and the refractory has a desulfurizing ability.

26. A method according to any one of claims 6, 7, 11 and 19, wherein the refractory material further includes at least one compound selected from the group consisting of MgO, $Al_2O_3$, $SiO_2$, $ZrO_2$ and $TiO_2$ and wherein the immersion nozzle further comprises a supporting refractory which supports said refractory.

27. A method for continuous casting of steel comprising supplying molten steel into a mold using an immersion nozzle, characterized in that a molten-steel introducing port is formed to inject a gas having a desulfurizing ability from inside of a sidewall portion and via an inner wall surface thereof, part of the molten steel flowing through the molten-steel introducing port is desulfurized by the injected gas having a desulfurizing ability, said part of the molten steel being present at the inner wall surface portion.

28. The method according to claim 27, characterized in that the gas having a desulfurizing ability is at least one gas selected from the gas consisting of Mg gas, Ca gas, Mn gas and Ce gas.

29. A method for continuous casting of steel comprising supplying molten steel into a mold using an immersion nozzle, characterized in that a molten-steel introducing port is formed to inject at least one gas selected from the gas consisting of Mg gas, Ca gas, Mn gas and Ce gas from inside of a sidewall portion and via an inner wall surface of the molten steel introducing port, wherein said at least one gas is injected to the molten steel flowing through the molten steel introducing port.

* * * * *